US005254066A

United States Patent [19]

Brown et al.

[11] Patent Number: 5,254,066

[45] Date of Patent: Oct. 19, 1993

[54] USER FORCE APPLICATION DEVICE FOR AN EXERCISE, PHYSICAL THERAPY, OR REHABILITATION APPARATUS

[75] Inventors: Michael L. Brown, Jeffersonville, Ind.; Jan W. Miller, Louisville, Ky.; Wilbur W. Spatig, Sellersburg, Ind.; Dean M. Zigoris, Louisville, Ky.

[73] Assignee: Motivator, Inc., Louisville, Ky.

[21] Appl. No.: 765,026

[22] Filed: Sep. 24, 1991

Related U.S. Application Data

[63] Continuation-in-part of Ser. No. 668,588, Mar. 13, 1991.

[51] Int. Cl.[5] ..... A63B 21/00; A63B 103/00

[52] U.S. Cl. ..... 482/137; 482/5; 482/91; 482/113; 482/902; 128/25 R; 73/379.09

[58] Field of Search ..... 482/1, 4, 5, 8, 91, 482/100-102, 111-114, 121, 126, 130, 135, 137, 44, 45, 93, 901, 902; 128/25 R, 25 B, 26; 73/379; 472/106-115

[56] References Cited

U.S. PATENT DOCUMENTS

| | | | |
|---|---|---|---|
| 3,323,366 | 6/1967 | Lorme, Jr. et al. | 482/5 X |
| 3,602,500 | 8/1971 | Cackowski | 472/106 |
| 4,550,908 | 11/1985 | Dixon | 482/113 |
| 4,629,185 | 12/1986 | Amann | 482/113 |
| 4,632,393 | 12/1986 | Van Noord | 482/114 X |
| 4,799,671 | 1/1989 | Hoggan et al. | 482/100 |
| 4,817,943 | 4/1989 | Pipasik | 482/137 X |
| 4,919,418 | 4/1990 | Hiller | 482/112 X |
| 4,973,043 | 11/1990 | Nolan | 482/127 X |

*Primary Examiner*—Richard J. Apley
*Assistant Examiner*—Joe Cheng
*Attorney, Agent, or Firm*—Middleton & Reutlinger

[57] ABSTRACT

The present invention relates to a user force application device which will optimally be used with a computerized exercise, physical therapy, or rehabilitation apparatus, preferably, an apparatus which permits concentric and eccentric isokinetic exercise by a user. One embodiment of the user force application device comprises a hollow outer cylinder, an inner cylinder inserted into the hollow outer cylinder and in co-axial alignment therewith, the inner cylinder being freely rotatable around its axis and freely slidable within the hollow outer cylinder along its axis. Grips of different size and shape can be provided which can easily be attached to the inner cylinder. The movement of the inner cylinder inside the hollow outer cylinder can be restricted. By attaching a larger cylinder to the inner cylinder and in co-axial alignment with it, rotational resistance can be provided. The user force application device can be secured to the exercise, physical therapy, or rehabilitation apparatus. The user force application device allows a user to perform various combinations of multiplaner movements of the joints from the shoulder to the fingers.

17 Claims, 15 Drawing Sheets

USER FORCE APPLICATION DEVICE FOR AN EXERCISE, PHYSICAL THERAPY, OR REHABILITATION APPARATUS

This is a continuation-in-part application for U.S. Patent application Ser. No. 07/668,588, filed Mar. 13, 1991, pending.

BACKGROUND OF THE INVENTION (a) Field of the Invention

Application Ser. No. 07/668,588 relates to a computerized exercise apparatus generally used for exercise, physical therapy, or rehabilitation having improved features. More particularly, the computerized exercise apparatus permits concentric and eccentric isokinetic exercise by a user where apparatus calibration is accurately determined before exercise to compensate for the user selected force application device, the push assembly means, if used, and environmental factors; where hydraulic flow can be accurately controlled by use of an alternating current dither circuit; where multiple user force application devices, a push assembly means, and a detachably connectable operator support are available for a myriad of exercises; and where the instantaneous forces measured during user exercise are displayed to the user in such a novel way so as to motivate the user to maximize their exercise efforts and thereby obtain increased personal benefit.

The present invention is directed to a user force application device which allows multiplanar movements of the finger, hand, wrist, and arm. More specifically, a user grips the device and, depending upon the configuration, either pushes the device away from the body or pulls the device toward the body, while at the same time, rotating his or her hand and forearm in either a clockwise or counter-clockwise motion. The user then resists as an exercise, physical exercise, or rehabilitation device returns the device to its initial position.

(b) Description of the Prior Art

The world of exercise equipment has grown from the days of bar bells and free weights. There are exercise machines having a user selectable weight and a system of levers, pulleys, chains, and other hardware such that a user can lift and lower the selected weight for the exercise the machine is designed to accomplish. These machines are of the type known under the trademarks "UNIVERSAL" and "NAUTILUS". All of these have the disadvantage that the same weight is used for both lifting and lowering and for each repetition of the exercise, unless the user interrupts his routine to change the weight amount.

Exercise equipment using an adjustable hydraulic piston and cylinder for variable user force application is taught in European Patent Application 0,135,346 to Wu. U.S. Pat. No. 4,063,726, to Wilson, teaches an electronically controlled exercising system which proportions the exercise resistance in the two directions of piston movement using a variable speed pump motor and a series to open or closed valves. U.S. Pat. No. 4,307,608, to Useldinger et al, teaches using the output of a load cell to determine peak force applied to the load cell under tension or compression and displaying this peak force to the user while the user is exercising.

Other devices which couple an exercise apparatus to a computer to allow for a programmed or selected exercise routine and to display some results of the exercise are taught. U.S. Pat. No. 4,358,105, to Sweeney Jr., teaches an exercise cycle which is programmable to simulate cycling over a level or hilly path and displays variables such as hill profile, calories, and time of exercise through a series of light displays. U.S. Pat. No. 4,765,613, to Voris, teaches a varying resistance lifting mechanism which has a microprocessor which controls the resistance and calculates the user performance and displays this performance to the user.

U.S. Pat. No. 4,714,244, to Kolomayets et al, teaches a rowing machine having a video display which displays user instructions and the user's performance in relation to a "PACER" boat, along with landscapes and buoys. The "PACER" boat speed is varied by a microprocessor dependant upon the difficulty and duration of the exercise selected by the user. U.S. Pat. No. 4,735,410, to Nobuta, also teaches a rowing machine having a cathode ray tube display which allows a user to simulate rowing against various currents and winds and in waters having shorelines and obstacles.

U.S. Pat. No. 4,919,418, to Miller, teaches a computerized drive mechanism for exercise, physical therapy and rehabilitation which provides for isokinetic exercise reciprocating between the concentric and compulsory isokinetic eccentric modes. Improvements to the mechanisms taught in the Miller patent are the focus of application Ser. No. 07/668,588.

Additionally, numerous patents have been issued which teach various hand, wrist, and forearm exercise devices, which relate to the present invention. U.S. Pat. No. 4,337,050, to Engalitcheff, Jr., teaches a method and apparatus for rehabilitation of damaged limbs, whereby the handles of familiar tools are attached to a shaft and turned by a person against a preselected resistance which is set to correspond to normal tool operation. U.S. Pat. No. 4,570,925, to Kock et al, teaches a device for exercising muscles associated with elbow tendinitis, including also the hand and wrist, whereby the user presets a resistance based upon his or her capabilities and then completes a desired exercise to overcome this resistance. U.S. Pat. No. 4,811,944, to Hoff, teaches an arm exercising apparatus designed to closely duplicate arm wrestling. Finally, U.S. Pat. No. 4,836,531, to Niks, teaches a hand and wrist exercising means for use by piano players.

DEFINITIONS

Throughout the application the following terms are used as defined below.

(a) Isokinetic: exercise where the speed of exercise motion is held constant during a dynamic contraction, so that external resistive force varies in response to magnitude of muscular force.

(b) Concentric: exercise where there is movement in the direction force is applied, for example, a bar bell being lifted from the floor.

(c) Eccentric: exercise where there is movement in the direction opposite to the direction of the force applied, for example, a bar bell being lowered to the floor.

(d) Compulsory isokinetic eccentric: constant velocity movement regardless of resisting force imposed by the user.

SUMMARY OF THE INVENTION

The present invention is for an improved computerized exercise apparatus which permits concentric and eccentric exercise by a user. Furthermore, in the improved apparatus, calibration is accurately determined before exercise to compensate for the user selected force application device, the push assembly means, if used, and environmental factors. Even further, in the improved apparatus, hydraulic fluid flow is accurately controlled by the use of an alternating current dither circuit. Also, in the improved apparatus, in order to greatly increase the utility of the apparatus, a variety of user force application devices, a push assembly means, and a detachably connectable operator support are available for the user, depending on the exercise selected. Additionally, the improved apparatus implements innovative video screen displays which present comparisons of past and present exercise routines by repetition to motivate the user to maximize his or her exercise effort in order to obtain the maximum personal benefit from the exercise.

More particularly, the present invention comprises an improvement to an exercise apparatus having a linearly extendable and retractable tension transmitting device having a first end detachably connected to a user selected force application device and a second end connected to a movement control means which regulates the extension and retraction of the tension transmitting device, said control means being operably connected to a force measuring device which determines the tension applied to said tension transmitting device and provides an electronic signal representing this tension to a control computer, the improvement which comprises: means for calibrating the exercise apparatus to compensate for the user selected force application device and changes in environmental factors, and the push assembly means, if used.

Additionally, the present invention comprises an improvement to an exercise apparatus having movement control means comprising a hydraulic cylinder containing a piston connected to a piston rod extending from said hydraulic cylinder and a hydraulic pump system to provide a desired hydraulic fluid flow through hydraulic lines to said hydraulic cylinder by the use of a bidirectional proportional flow control valve in said hydraulic lines, the improvement which comprises: means for dithering said proportional flow control valve.

Furthermore, the present invention comprises an improvement to an exercise apparatus having a supporting structure, a tension transmitting device supported by said supporting structure and a user force application device detachably connectable to said tension transmitting device, the improvement which comprises: a push assembly means pivotally connected to said supporting structure and detachably connectable to said tension transmitting device and said user force application device, wherein said tension transmitting device and said user force application device are detachably connected to said push assembly means instead of each other.

Also, the present invention comprises an improvement to an exercise apparatus having a computer video monitor, the improvement which comprises: displaying, at the start of a new exercise routine, at the bottom of the video monitor in a first color, the force exerted by the user during the last exercise routine for both concentric and eccentric cycles in a series of vertical bar-graphs corresponding to the number of repetitions previously performed; displaying for each repetition a pair of horizontal bar-graphs at the top of the video monitor, the first horizontal bar-graph in the first color representing force exerted by the user during the comparable repetition in the last exercise routine, the second horizontal bar-graph in a second color representing force exerted by the user which is less than or equal to the force exerted in the last exercise routine and in a third color representing force exerted by the user which exceeds the force exerted in the last exercise routine; displaying, at the bottom of the video monitor in the second and third color, if applicable, in a vertical bar-graph, the results of each repetition of the new exercise routine as completed, the vertical bar-graph being adjacent to the displayed comparable repetition bar-graph from the last exercise routine.

Finally, the present invention comprises an improvement to an exercise apparatus having a support structure having a base having threaded holes therein, the improvement which comprises: an adjustable operator support, said operator support being detachably connectable to said base of said support structure, said operator support having front and rear horizontal leg assemblies, said front horizontal leg assembly being shorter that said rear horizontal leg assembly to compensate for the thickness of said base of said support structure, said front horizontal leg assembly having a pair of holes therein, a pair of retractable spring loaded screw down assembly means attached to said holes in said front horizontal leg assembly, wherein when said adjustable operator support is to be detachably connected to said base of said supporting structure, said pair of retractable spring loaded screw down assembly means are aligned with said threaded holes in said base of said support structure and then screwed into said threaded holes by the user.

The present invention relates to a user force application device which allows multiplanar movements of the finger, hand, wrist, arm, and shoulder. More specifically, a user grips the device and, depending upon the configuration, either pushes the device away from the body or pulls the device toward the body. In the alternative, the user can rotate his or her hand and arm in either a clockwise or counter-clockwise motion. Also, these movements can be combined, resulting in the user doing a push and twist or a pull and twist exercise. When the user force application device of the present invention is connected to the exercise, physical therapy, or rehabilitation apparatus of the parent invention, the user additionally provides resistance as the exercise, physical therapy, or rehabilitation apparatus returns the device to its initial position.

Even more specifically, the present invention is for a user force application device, comprising: a hollow outer cylinder having a connector end and a user end, an outer surface and an inner surface, and an axis; an inner cylinder having a connector end and a user end, an outer surface, and an axis, said inner cylinder inserted into said hollow outer cylinder and in co-axial alignment therewith, said inner cylinder being freely rotatable around said axis and freely slidable within said hollow outer cylinder along said axis, said connector ends of said hollow outer cylinder and said inner cylinder opposing said user ends of said hollow outer cylinder and said inner cylinder.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

The implementation of the robotic fitness machine is encompassed in four major systems: mechanics, hydraulics, electronics, and software.

Figure 1:
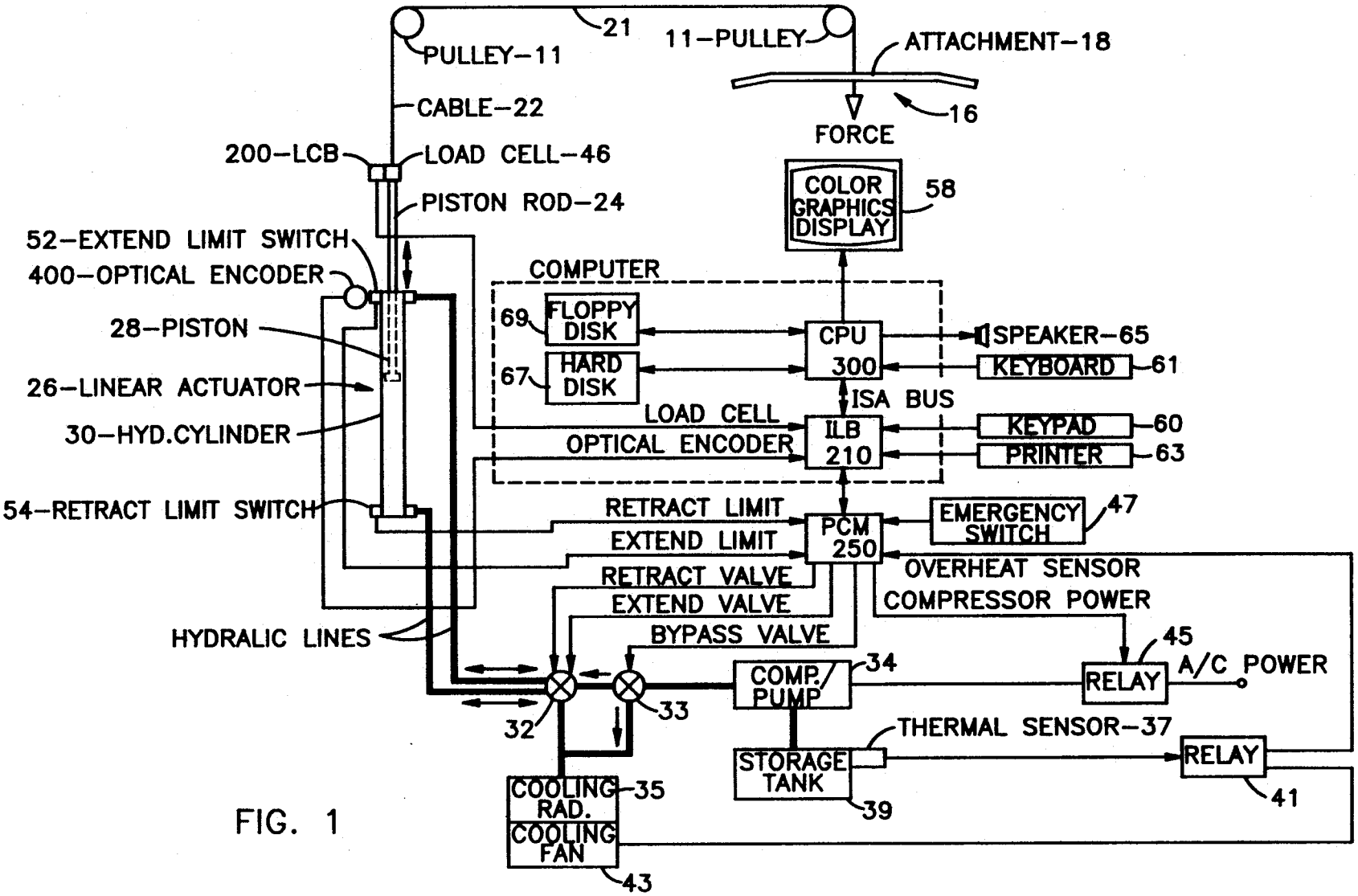
FIG. 1 shows the connectivity of the mechanics, hydraulics, and electronics systems of the exercise apparatus of the preferred embodiment.

FIG. 1 shows a schematic interconnection of the first three of these systems, shown as a pull-down apparatus. The user applies force to a selected user force application device 16 which is connected to a tension transmitting device 21. In this figure, the user force application device attachment 16 shown is a pull-down bar 18 and the tension transmitting device 21 is a flexible cable 22. Flexible cable 22 is supported by pulleys 11 connected to a supporting structure, which is not shown in this figure. The force applied by the user creates cable tension which is transmitted to a load cell 46. The load cell 46 senses the force applied and provides a voltage proportional to that force. The voltage is amplified to a proper working level and filtered to remove electrical noise. This is done within the Load Cell Board (LCB) 200. The amplified signal is sent to the Interface Logic Board (ILB) 210. An analog-to-digital converter, not shown in this figure, converts the signal from analog to digital. This digital signal is available to the central processing unit (CPU) 300 and hence provides digital force reading samples to software executing on the CPU 300.

The load cell 46 is attached to the moving end of a piston rod 24, which is part of the linear actuator system 26. It is noted that an electrical linear actuator could be used instead of the hydraulic linear actuator now described. Piston rod 24 is connected to a piston 28 which is inserted into hydraulic cylinder 30 containing hydraulic fluid. Also, a rotational optical encoder 400 is mechanically linked to the moving end of the piston rod 24. The optical encoder 400 generates signals indicative of the position displacement and direction of movement of the piston rod 24. These signals are fed to the ILB 210, which in turn provides this position and direction of movement information to the CPU 300. The signals generated by the optical encoder 400 provide a relative distance measure. Magnetically controlled limit switches 52 and 54 on either end of the hydraulic cylinder 30 provide absolute position references, indicating piston rod 24 being fully extended or fully retracted, respectively. These extend limit and retract limit signals are fed into the Power Control Module (PCM) 250.

Computer controlled movement of the piston rod 24 is implemented with the ILB 210 and PCM 250. A bidirectional proportional flow valve 32 is controlled by the PCM 250. The control signals are derived from the ILB 210 and sent to the PCM 250. The bidirectional proportional flow valve 32 allows the piston rod 24 to move in or out of hydraulic cylinder 30 at any programmed rate, limited only by the physical limits of the hydraulic pump/compressor 34. Direction of movement of piston rod 24 is controlled by the bidirectional proportional flow valve 32, which is electrically controlled by the computer. Proportional flow valve 32 comprises two solenoid valves. Each solenoid valve controls inlet flow to a given end of hydraulic cylinder 30. Adjusting current through the solenoid coil controls the flow-rate of the hydraulic fluid. A dithering circuit is used to alleviate friction in the solenoid spool. This circuit is described in detail later. A bypass valve 33, also computer controlled, provides a means for the hydraulic fluid to bypass the hydraulic cylinder 30 and flow through the cooling radiator 35. This provides an expedient means to cool the hydraulic fluid. A thermal sensor 37 located in the hydraulic fluid storage tank 39 energizes a relay 41 which energizes a cooling fan 43 on the cooling radiator 35 when the temperature reaches an overheat temperature. Also, at this overheat temperature, a signal is sent to the CPU 300 via PCM 250 and ILB 210 to alert of this overheat condition. Power to hydraulic pump/compressor 34 is controlled by a relay 45, controlled by the computer. Emergency switch 47, when activated, causes the piston rod 24 to fully extend from hydraulic cylinder 30 to the extend limit through software means.

Input from and output to the user is accomplished by a specialized keypad 60, a standard typewriter-type keyboard 61, a printer 63, a speaker 65 and a color-graphics video monitor 58. Most of the user input occurs from the keypad 60, through the ILB 210. Feedback to the user is provided by the video monitor 58 and an audio speaker 65. The software generates real-time images in reference to the forces generated on the cable 22. A hard disk 67 provides database storage capability, the floppy disk 69 provides a means to transfer data between one or more computers.

The computer system maintains control over all other portions of the apparatus. As an overview, interfacing the computer to the physical system is accomplished by three electronic subassemblies: the Interface Logic Board (ILB) 210, Power Control Module (PCM) 250, and the Load Cell Board (LCB) 200. The ILB 210 is directly connected to the computer system and provides the interface between the CPU 300 and the physical controls. The PCM 250 drives high-current components such as solenoid valves and relay coils in the hydraulics system, as previously discussed. The PCM 250 isolates these components from the computer system hardware. The LCB 200 properly amplifies the weak signal generated by the load cell 46, used to measure tension on tension transmitting device 21. The LCB 200 may be physically located on load cell 46. LCB 200 also provides a means of implementing a low impedance driver. Both the PCM 250 and the LCB 200 connect to the ILB 210. Software controls elements of the ILB 210, which, in turn, controls various physical hydraulic functions. The ILB 210 also contains the necessary circuitry to convert load cell 46 signals from analog to digital, decode quadrature pulses from optical encoder 400, and decode key presses from keypad 60. ILB 210, PCM 250, and LCB 200 are now explained in greater detail.

Figure 2:
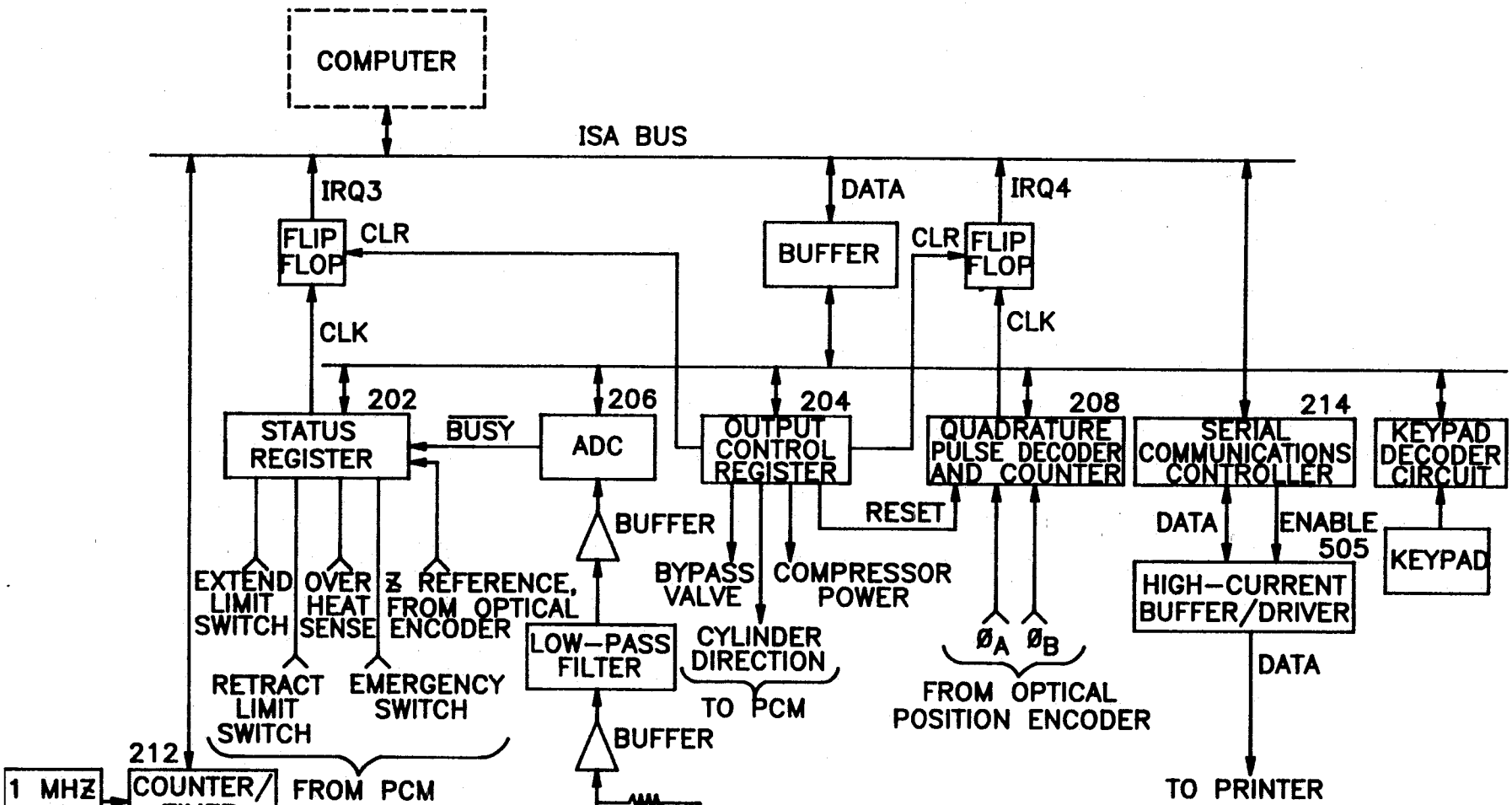
FIG. 2 shows connectivity of the Interface Logic Board.

FIG. 2 shows the connectivity of the ILB 210. ILB 210 provides the interfacing between the CPU 300 and all electrical features of the machine. There are seven major components of ILB 210: status register 202, output control register (OCR) 204, analog-to-digital converter (ADC) 206, quadrature-pulse decoder/counter 208, matrix keypad decoder 210, counter/timer circuit 212, and serial communications controller 214.

The status register 202 provides information about the physical state of the machine. It is a read-only register and has the following layout:

Bit Status

0 Keypad data available.
1 ADC busy.
2 Limit switch, top-of-cylinder.
3 Limit switch, bottom-of-cylinder.
4 Emergency extension switch.
5 Over-temperature detected.
6 Optical encoder Z reference output.
7 Reserved.

Bit 0, when active, signals that a key was pressed on the keypad 60. Bit 1 is active when the ADC 206 is busy, during a conversion. Bit 2 is active when the piston rod 24 is completely extended from hydraulic cylinder 30. This condition is tripped by a magnetic limit switch 52, which is mounted at the top of the cylinder 30. Bit 3 is active when the piston rod 24 is completely retracted into cylinder 30. Magnetic limit switch 54, mounted at the bottom of cylinder 30 detects this condition. Bit 4 reflects the state of a push-button switch 47 used in emergency circumstances. Bit 5 is active when the hydraulic fluid is elevated to a given temperature, as designated by a thermal sensor 37 located in the hydraulic fluid storage tank 39. Bit 6 is connected to the optical encoder 400, which tracks the position of the piston rod 24, and produces a Z output signal. A pulse appears on the Z output every 1 revolution of the optical encoder 400. Bit 7 is not used in this preferred embodiment.

The output control register (OCR) 204 provides electrical control over a number of the hydraulic components. It is a bit addressable register. Its layout is as follows:

Bit Function

0 High-order byte enable for ADC.
Reset quadrature-decoder counter.
2 Clear interrupt request 4.
3 Clear interrupt request 3.
4 Hydraulic compressor power.
5 Bypass valve energize.
6 Cylinder direction.
7 High-order byte enable for quadrature-decoder.

Bit 0 is used to control access to the high/low order data bytes from the ADC 206. The ADC 206 has a 12 bit output, therefore, two bytes are necessary for a complete data sample. Bit 1 is used to reset the position counter in the quadrature-decoder 208. Bit 2 is used to clear interrupt request 4 which is generated by the quadrature-decoder 208. Bit 3 is used to clear interrupt request 3 which is generated by the limit switches 52 and 54, overheat sense relay 41, and emergency switch 47. Bit 4 engages the hydraulic compressor/pump 34. Bit 5 engages the hydraulic bypass valve 33. Bit 6 controls the direction of movement of piston rod 24, either in or out of hydraulic cylinder 30. Bit 7 allows high/low order byte access for the quadrature decoder 208.

The analog-to-digital converter (ADC) 206 is used to obtain measurements representing the force exerted on the tension transmitting device 21 and detected by load cell 46. The ADC 206 features a minimum of 12 bits precision. An important feature is the input buffer section. A voltage directly proportional to force exerted is received as an input to the ILB 210, this signal is then fed to an operational amplifier with an input impedance set to approximately 2.2 k Ohms for increased tolerance to noise. The operational amplifier provides a buffering and filtering function. A low pass filter is used to eliminate RF interference and noise. This filter has a cut-off frequency of no less than 10 Hz. An extra operational amplifier buffer is placed between the filter circuit and the input to ADC 206. Power to the operational amplifier and ADC 206 is isolated by a dedicated voltage regulator augmented with isolation resistors and capacitors. The ADC 206 itself is a standard off-the-shelf type integrated circuit.

The quadrature-decoder 208 is used to convert signals from a rotary optical position encoder 400 to a position count value. The optical encoder 400 has two outputs which provide signals representing the amount of rotation of the encoder 400 and the direction of rotation. This information is maintained on a position counter internal to decoder 208, thus providing the position of the piston rod 24 anywhere in its travel to an accuracy limited only by the encoder 400 itself. The selected encoder 400 should have a minimum accuracy of 1/6 of an inch, linear travel. An interrupt (IRQ4) is generated when the decoder 400 has detected motion of the piston rod 24 in either direction.

The keypad matrix-decoder 210 uses an off-the-shelf integrated circuit to scan a momentary matrix keypad 60 for depressed keys. This circuit features key decoding and debounce. The decoding procedure derives a key code value for each key per row/column. The debouncing feature eliminates mechanical bouncing of the switch contact when a key is pressed.

The counter/timer 212 is an off-the-shelf integrated-circuit providing timing functions. Its principal use is to develop a pulse-width modulated signal to drive the bidirectional proportional flow control valve 32. It provides 3 timer channels. One channel is used to develop a square-wave signal for use as a basis for pulse-width modulation. The second channel outputs the pulse-width modulated signal to the PCM 250 for use in the proportional flow control valve 32. The third channel is used for software timing functions, determining the piston rod 24 velocity during operation.

The serial communications controller 214 is based on an off-the-shelf integrated circuit and provides a means of communicating with a serial printer 63 or provides a communications network interface function to interface with other similar apparatuses. The unique portion of this circuit is the output section 505. Serial encoded information is passed to the output drivers which offer high-current drive for lengths of cable up to 500 feet in length. The output section features a software controlled means of electrically disconnecting the transmitter driver from the communications wire external to the apparatus. This provides a means for a multiple-receiver, single-transmitter networking scheme for use in file and peripheral (printer) sharing.

Figure 3:
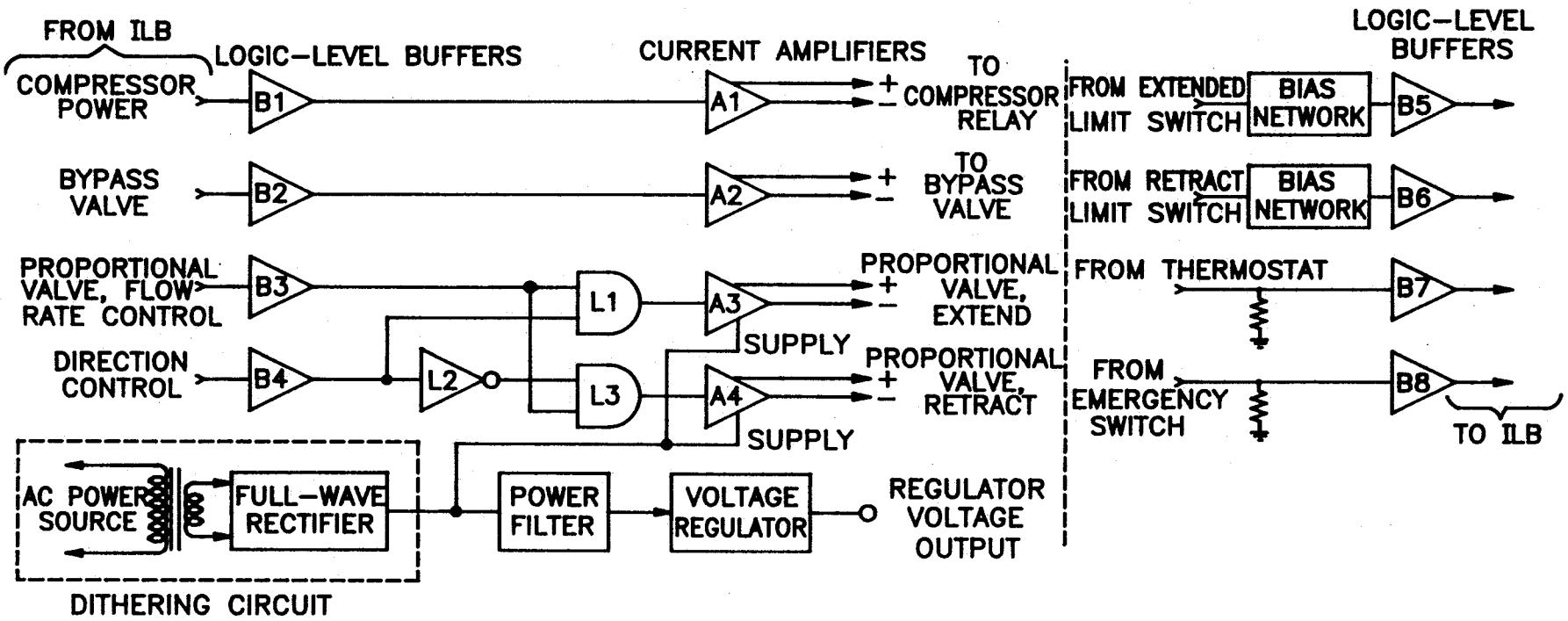
FIG. 3 shows connectivity of the Power Control Module.

FIG. 3 shows the connectivity of the PCM 250. PCM 250 is used to drive high-current elements of the electrical control system. It is also used to interface and buffer various sensor switch inputs and provide them to the computer. Control signals emanate from the ILB 210. Input signals represent hydraulic compressor/pump 34 power, bypass valve 33 energize, flow rate through proportional valve 32 and piston rod 24 direction of movement. Buffers B1, B2, B3, and B4 provide a means for driving high-current amplifier devices A1, A2, A3, and A4. Logic devices L1, L2, and L3 provide a means of direction control. The direction control is a binary logic value which is used to select either A3 or A4 devices but not both. A3 drives the proportional valve 32 for the extend direction, A4 drives the proportional valve 32 for the retract direction.

The valve 32 control signal is a pulse-width modulated digital signal from the ILB 210. It is a low-voltage, low-current, logic-type signal. This is amplified by devices A3 or A4, depending on the direction signal, and is used to drive the applicable solenoid in the proportional flow control valve 32. The power source for these devices is from a pulsing-DC supply. This is used to form a dithering effect. This dithering circuit will be described in greater detail later.

The PCM 250 also provides for buffering of the output of sensors 41, 47, 52 and 54 for the ILB 210. This is provided by buffers B5, B6, B7, and B8. Resistor networks N1 and N2 provide operating current for the magnetic limit switches 52 and 54 located on hydraulic cylinder 30. The buffered signals from B5, B6, B7, and B8 are transmitted electrically to the ILB 210. These signals are logic level and are fed into status register 202 on ILB 210. From this, the computer may access these sensor values.

Figure 4:
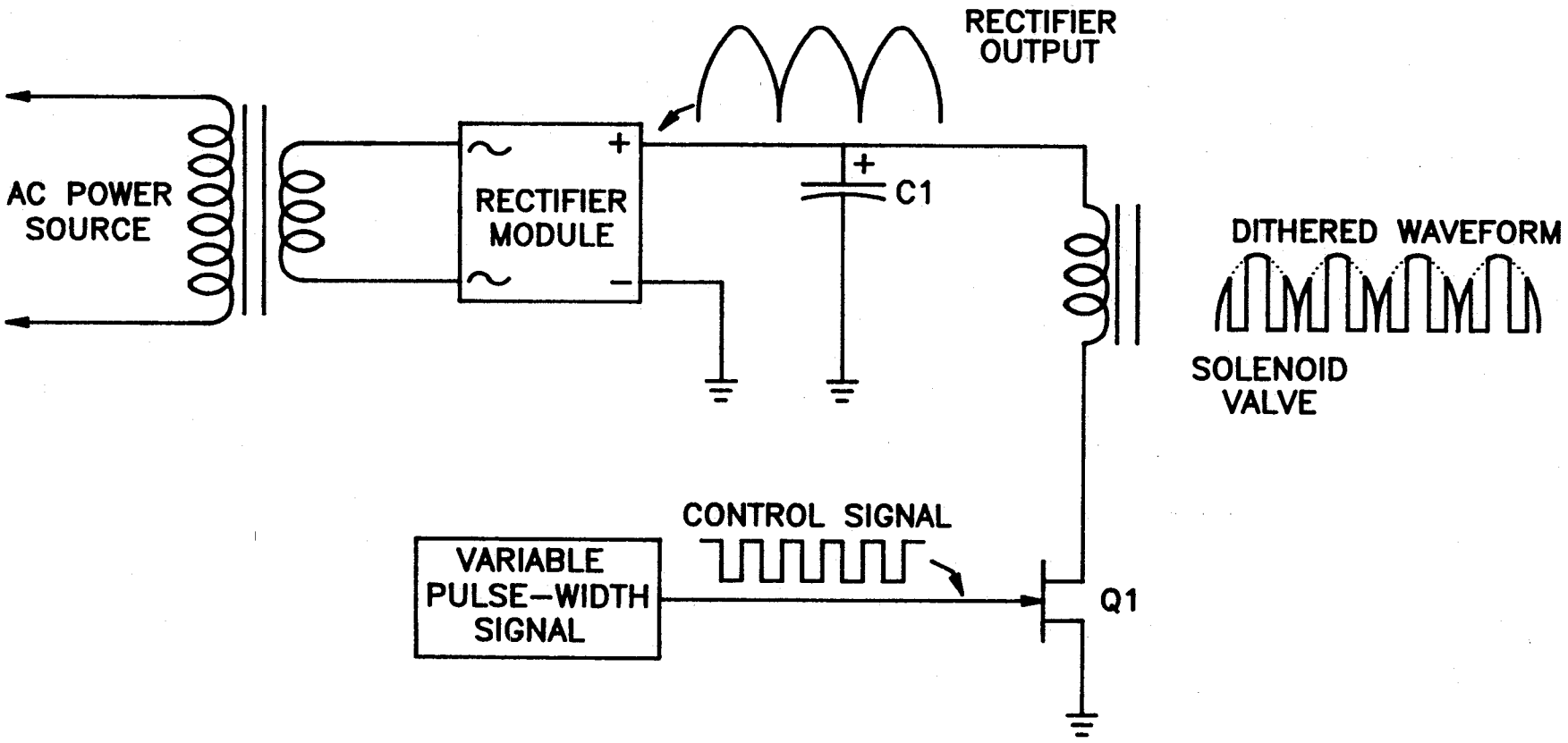
FIG. 4 shows the dither circuit.

FIG. 4 shows how the dithering effect is generated from an alternating current power source. As background, proportional control based on solenoid-type devices requires a controllable current to adjust the position or degree of control. In this preferred embodiment, the proportional control is for hydraulic flow valves. For a given current flowing through the valve solenoid, the valve moves to a particular position. A problem with such solenoid controls is that when a control is placed in a position, it will have a tendency to stick in that position if it stays in that position for a period of time. As a result of this sticking, over time the valve becomes inconsistent in terms of its position with respect to the control current. A common solution in the industry has been to inject a low frequency element into the control valve to vibrate it continually. This is called dithering. The dithering movement of the valve is inconsequential when compared to the control position. The standard dithering technique has been to create a pulsating wave from a direct current power source, then pulse-width modulate this signal to control the solenoid. This requires a dither waveform generator and an amplifying device to supply the generated waveform at the proper current levels to another amplifier device to provide the pulse-width modulation.

As shown in FIG. 4, the dithering circuit of the preferred embodiment produces a dithering effect using alternating instead of direct current. The alternating current line power is fed through a transformer to match the necessary voltage and current requirements of the solenoid. The alternating current is then either full or half wave rectified to generate a pulsating direct current signal. This forms the basis of the dithering waveform. Generally, the alternating current frequency should be 200 Hz or less, because the higher the frequency, the less dithering that will occur because of limitations in the mechanical response of the solenoid. The pulsating direct current signal is then supplied to a current amplifying device Q1 which is modulated by a pulse-width modulation signal to control the solenoid proportional flow valve 32. The dithering enhances consistent valve positioning ability.

Figure 5:
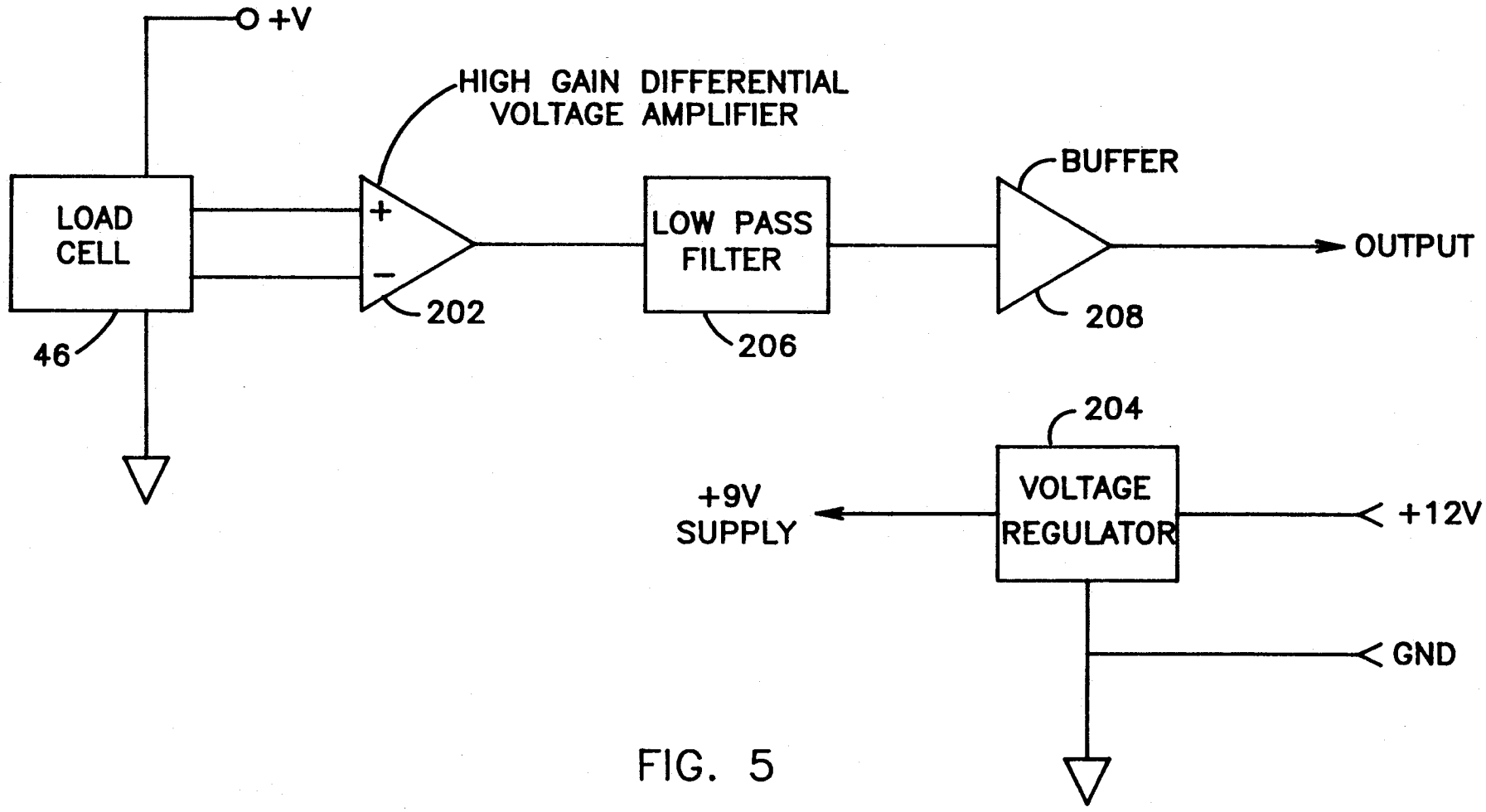
FIG. 5 shows connectivity of the Load Cell Board.

FIG. 5 shown the LCB 200 electrical connectivity. As was previously described, load cell 46 is placed between the movable end of the piston rod 24 and tension transmitting device 21. Hence, the load cell 46 moves with the piston rod 24. Attached directly to the load cell is a voltage amplifier device 202, which is required because a typical load cell 46 generates very low voltages. In the preferred embodiment, the amplifier 202 is placed in close proximity to the load cell 46. By amplifying the load cell 46 voltage, noise immunity is significantly enhanced. The load cell 46 develops a voltage from an excitation voltage supplied to it. This load cell 46 voltage signal, typically in the range of 0–10 millivolts, is fed into a differential mode amplifier 202 which linearly amplifies the signal and produces an output relative to the input voltage. The amplification factor is set so that the load cell output covers the operating voltage supply range. Low pass filter 206 removes noise components from extraneous sources. Load cell 46 response is generally below 20 Hz, therefore, the filter 206 cut-off frequency is designed to be approximately 20 Hz. Buffer 208 provides a low-impedance output which is provided to ILB 210 and processed as previously described.

Figure 6:
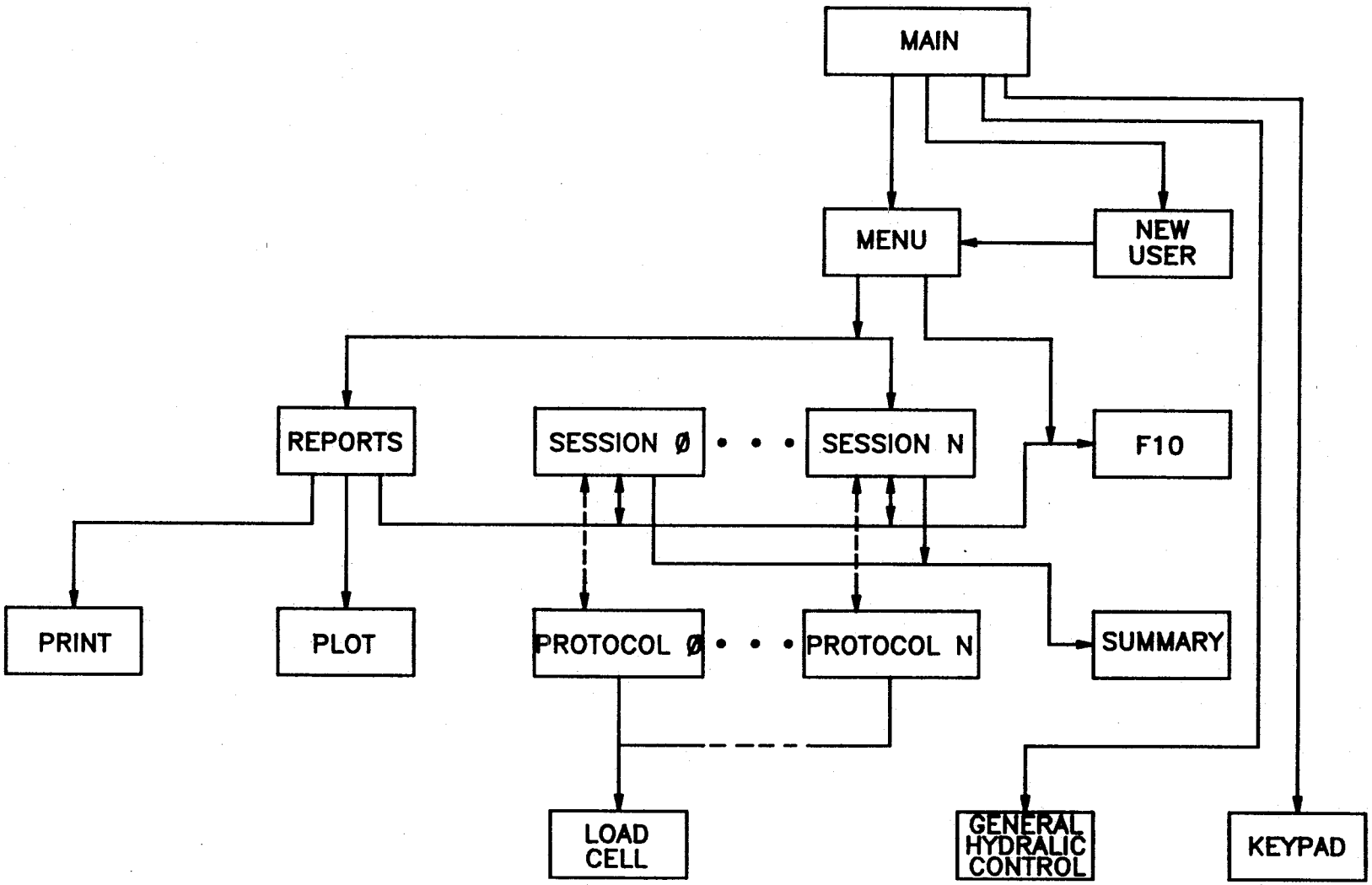
FIG. 6 provides a software overview.

The software provides all control mechanisms for the apparatus. Its function is to integrate sensor information, generate database information, and control the hydraulic system. A unique feature of the apparatus is that it produces a display which compares, in real-time, force generated by the user from current and previous sessions. These forces can be displayed in a graphical form, such as a bar-graph, to provide a motivational workout goal, based on the user's own abilities. FIG. 6 shows an overview of the software system broken into functional modules.

Module MAIN is the system entry point and execution begins at this point. The module initializes data items and hardware control elements, such as the graphics display, hydraulic valves, and position decoder.

The MENU module is responsible for controlling user access to the features of the apparatus. This is done using menu screens from which the user selects various exercises. The user also has the ability to customize the various exercise-type options. This is also performed within the MENU module.

Module NEWUSER is strictly responsible for adding new users to the database. It prompts the user for various relevant information such as their name, ID code, and piston rod 24 extension and retraction limits.

The F10 module is the database management code. It maintains all data structures and provides all file access for the system.

The GENERIC HYDRAULIC CONTROL module provides basic hydraulic services such as piston rod 24 retraction and positioning, valve 32 and 33 controls, and various access services to the ILB 210.

The KEYPAD module provides access to the specialized keypad 60.

The REPORTS module generates printer reports from the database. It invokes the PRINT and PLOT modules. PRINT provides hardware access to the printer. The PLOT module is responsible for generating graph plots for the printer.

The SUMMARY module generates a workout summary on the display 58 immediately after a workout.

The LOADCELL module controls access to the load cell 46 signals.

Of principal importance are the SESSION and PROTOCOL modules. These modules provide the exercise operation of the apparatus. A module exists for each mode of apparatus operation. For instance, SESSION0/PROTOCOL0 might represent an isokinetic mode of workout, where SESSION1/PROTOCOL1 performs work-evaluation testing on a user. Each SESSION/PROTOCOL module set is responsible for a general operation mode. In the former example, a selection of isokinetic workouts might include such exercises as pull-downs, chin-ups, tricep-push-downs, curls, etc. Each mode of operation may encompass a variety of exercises, and for each mode there will exist a SESSION/PROTOCOL set of routines. The software is designed to allow for a number of such modes, where new modes of operation can be added to the current software system. In particular, the SESSION module generates the display screens for the user. The PROTOCOL module controls the hydraulics and data acquisition. The function of each is described in greater detail for a mode 0, isokinetic, workout.

The SESSION module produces displays on display unit 58 while the piston rod 24 extends and retracts at a constant velocity between two positions which are preset for each user. The velocities for the extend and retract directions are preset and may be different. The user selects a mode 0 exercise, such as a chin-up. The system prompts on display 58 the user to connect the appropriate user force application device 16, for this exercise a bar 18, on the tension transmitting device 21, in this embodiment a cable 22. The user is then instructed to remove his or her hands from the bar 18 after which the computer takes calibration readings. After the calibration, the hydraulic compressor/pump 34 is powered up and the bar 18 is positioned to an initial retracted starting point. The display 58 will now display the previous workout averages for each repetition on the bottom of the screen. The user is then prompted to begin the exercise. The apparatus will enter a standby state and the user has about 10 seconds to apply force to the bar 18. If no force is applied during this time interval, hydraulic compressor/pump 34 is powered down and the session is ended. If force is applied, then the apparatus will extend the piston rod 24. This is the extend cycle. The extension occurs at a preset velocity. The user should now exert force on the bar 18. The user may exert no force or force up to the limits of the hydraulics, typically in the range of 800 pounds. The piston rod 24 will continue to extend at the preset velocity. During this time, the display shows a blue bar-graph representation of the instantaneous force applied to the bar on the upper portion of the screen. Below it is a bar-graph of the previous workout force applied for the given position and repetition, this bar is displayed in green. If, during the current workout, the applies more force than the previous workout force, for the given position and repetition, the section of bar-graph representing additional force is displayed in red.

When the extended preset position limit is encountered, the direction of the piston rod 24, and hence the cable 22 and bar 18, changes. This is the retract cycle. When this change of direction occurs, an average of the forces exerted in the extending direction is displayed on a bar-graph in the lower half of the display screen. The bar is placed next to the corresponding average bar for the previous workout and same bar coloring rules are applied as in the above case. In the retract phase, operation is identical to that of extend phase. An instantaneous force bar-graph is displayed and compared to the previous workout as above. The piston rod 24 retracts at a preset retract velocity. When the piston rod 24 reaches the retract position limit a bar-graph representing the average of forces applied during the retract portion of the cycle is displayed. One repetition has now been completed. At the retracted position, the software, once again, enters the standby state. The user may conclude the workout by removing any applied force before the bar reaches the retract limit position. When in the standby state, with no force applied to the bar, the piston rod 24 remains motionless until either force is applied or a preset timeout limit is reached. If force is applied then a new repetition begins. Otherwise, the workout session is completed after the timeout occurs.

Figure 7:
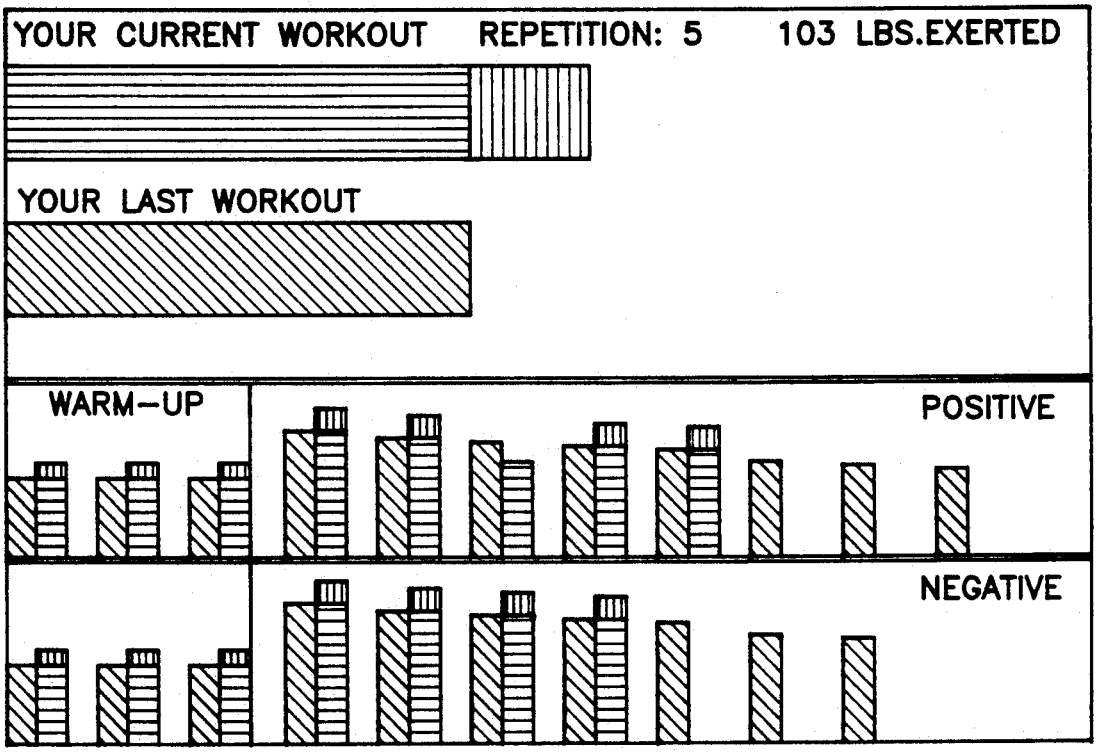
FIG. 7 shows a typical user display seen during exercise.

FIG. 7 depicts what the user will see while an exercise is underway. The user is completing the fifth repetition. The green upper horizontal bar depicts the last workout. The upper blue bar represents the forces currently being exerted less than or equal to the last workout. If the user exceeds his or her last workout, the excess force exerted is displayed in red, as shown. In this embodiment, there are three warm-up repetitions which do not figure in any of the statistical computations. As shown, the user has exceeded his or her previous workout except for the extend cycle of the third repetition after the three warm-up repetitions.

After the workout, SESSION generates comparative statistics for the current and previous workouts. These statistics include, but are not limited to, average force exerted during the entire workout for both the extend and retract cycles. Also, the average force for the single best extend and retract cycles are displayed. These statistics are displayed on the top-half of the screen.

The unique aspect of the display graphics produced by the SESSIONS module is the production of a real-time comparative performance display. As opposed to other machines, which provide non-instantaneous preprogrammed performance goals, this display is tailored to each user's abilities. This is because the user provides the data for performance. The comparative bar-graph display is designed to provide motivation for the user during a workout. When the user out-performs his or her previous workout, the bar-graph shows the excess force as a red-colored bar extension. A user will strive to see the display show red, hence the motivation.

While SESSION is controlling front-end of the user display, the PROTOCOL module controls the actions of the hydraulics and is responsible for obtaining and storing force samples. Operation of the PROTOCOL module is transparent to the user on the apparatus. For each mode of operation, as in the case of the SESSION modules, there is a corresponding PROTOCOL module. The PROTOCOL module is interrupt-driven with exception of various access mechanisms to allow control from the SESSION module. There are two interrupt entry points, from the position counter and from the timer interrupt. An entry point represents a starting point for execution of a routine. Operation is described for the isokinetic mode of operation, like that of the SESSION module described above.

As the cylinder moves a distance corresponding to the resolution of the optical encoder 400, the hardware position counter in the ILB 210 is incremented or decremented dependent on the direction of motion of the piston rod 24. Each time the counter changes, an interrupt is generated. A routine in the PROTOCOL module is executed. This routine monitors the position and is responsible for controlling the direction and velocity of the piston rod 24. It also obtains a load cell reading and stores it in an array, indexed by position, cycle (extend-/retract), and repetition. This array is ultimately used for statistical computations, as well being stored in the database for the next workout session. The SESSION module starts piston rod 24 motion by invoking a START MOTION routine. The START MOTION routine initializes data items used by the interrupt routines. This includes the piston rod 24 position limits, velocities, as well as internal state-variables for the interrupt routines. It initiates the process which opens the proportional valve 32 so that the piston rod 24 starts moving. As the piston rod 24 moves, interrupts are generated by the position counter. This interrupt routine takes a force sample and stores it into the array as mentioned above. It also compares the position, during the extend phase, to the extend limit position. If the limit has been reached, then the proportional valve is closed and time is given to allow the piston rod 24 to stop moving. The routine then exits. The timer interrupt is now invoked after a specified period of time. This routine is responsible changing the direction of motion of the piston rod 24 at the extend-to-retract point. When it is invoked, it moves the piston rod 24 in the retract direction, at a preset velocity. As the piston rod 24 retracts, position interrupts are generated. Again, the position interrupt routine is invoked, data is sampled and stored, and the position is checked against the retract position limit. When the limit is reached, motion is stopped. The SESSION module will enter the standby state. Motion will not begin again until the START MOTION routine is invoked again.

Figure 8:
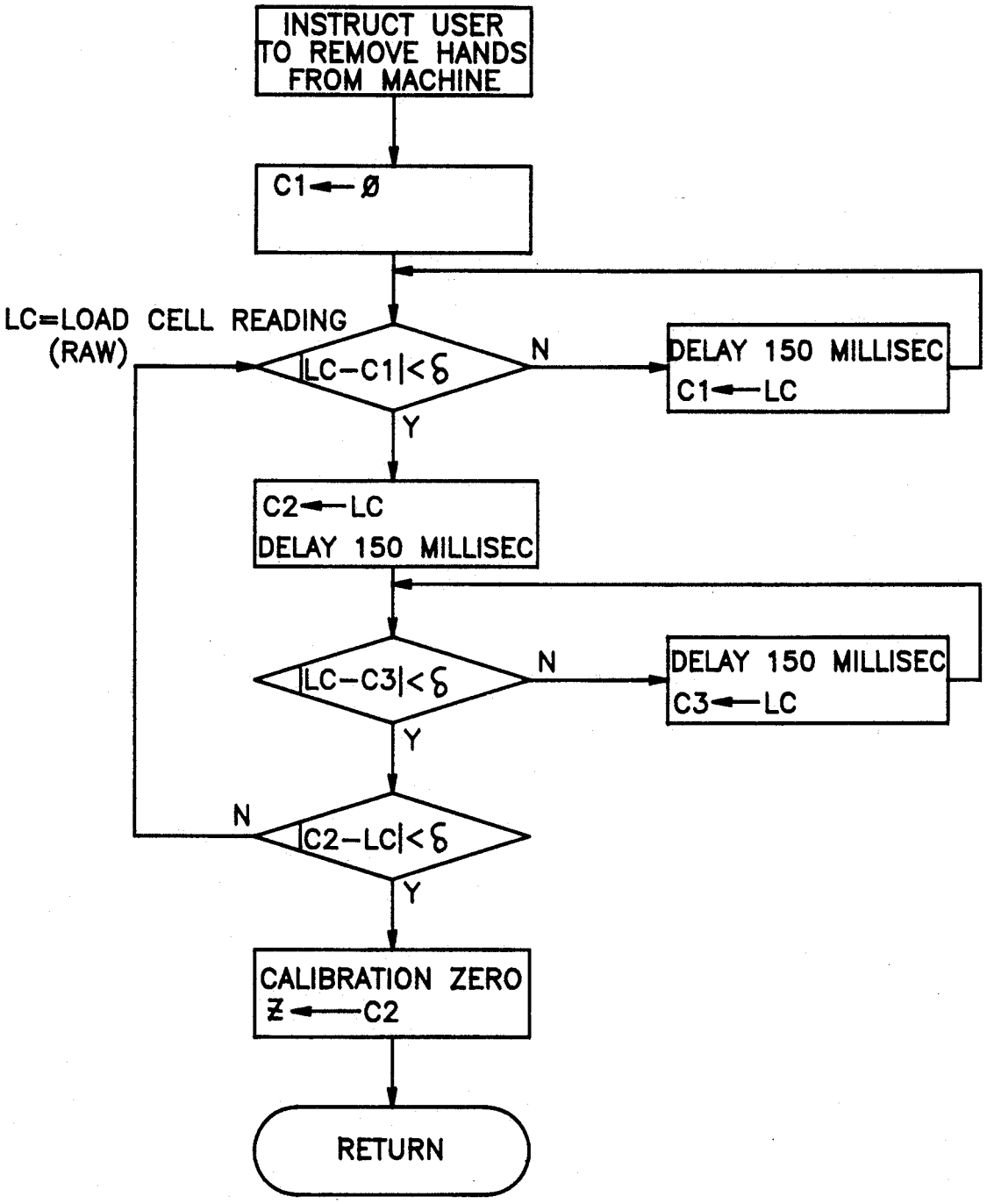
FIG. 8 shows the load cell calibration flow chart.

The user is capable of selecting a variety of user force application devices 16, such as the bar 18 in the previous example. Also a push assembly means 500 may be used. This is described later. Also, extension cables, or the like, may have to be added to the tension transmitting device 21 to allow the user to accomplish the desired exercise. The variety of the items which may be attached to the tension transmitting device, environmental factors, and possible long-term drift in the load cell 46 circuitry make it essential that the load cell be accurately calibrated to produce accurate performance statistics for the user. A flow chart of this calibration process is shown in FIG. 8. Employing a load cell 46 which produces a voltage output which is linear to the force applied to the tension transmitting device 21, a baseline reading can be obtained by reading the load cell voltage when the user is not applying any force. To insure that no variable forces exist on the tension transmitting device 21, the user is instructed to place the appropriate attachment on the tension transmitting device 21 and remove his or her hands from the attachments. Next, a series of readings (C1) are taken between a given time interval. LC refers to a load cell 46 voltage reading. C1, C2, and C3 are scalar variables which hold the various load cell readings used in the algorithm. LC and C1 are compared to each other and if within an error delta, a calibration reading, C2, is taken. Control is now delayed by a given amount to allow time between the next set of readings. Another set of readings (C3) are performed to insure steady force readings. These readings are obtained in the same manner as C1. Finally, C2 is compared to LC to insure consistency between the steady readings. If outside the error delta, the entire calibration process is repeated. Otherwise reading C2 is taken as a zero reference. The C1 and C3 readings attempt to insure no transient forces are applied to the tension transmitting device 21, before and after the calibration reading C2. A time-delay is implemented between readings since the mechanical and electrical response of the load cell circuit is on the order of 10 Hz. This procedure establishes a relative reference of the load cell with respect to the Analog-to-Digital converter 206, thus eliminating any long-term direct current drift. The low-level force sampling routine takes four readings from the Analog-to-Digital converter 206 and averages them. This reduces random noise present in the load cell electronics.

Figure 9:
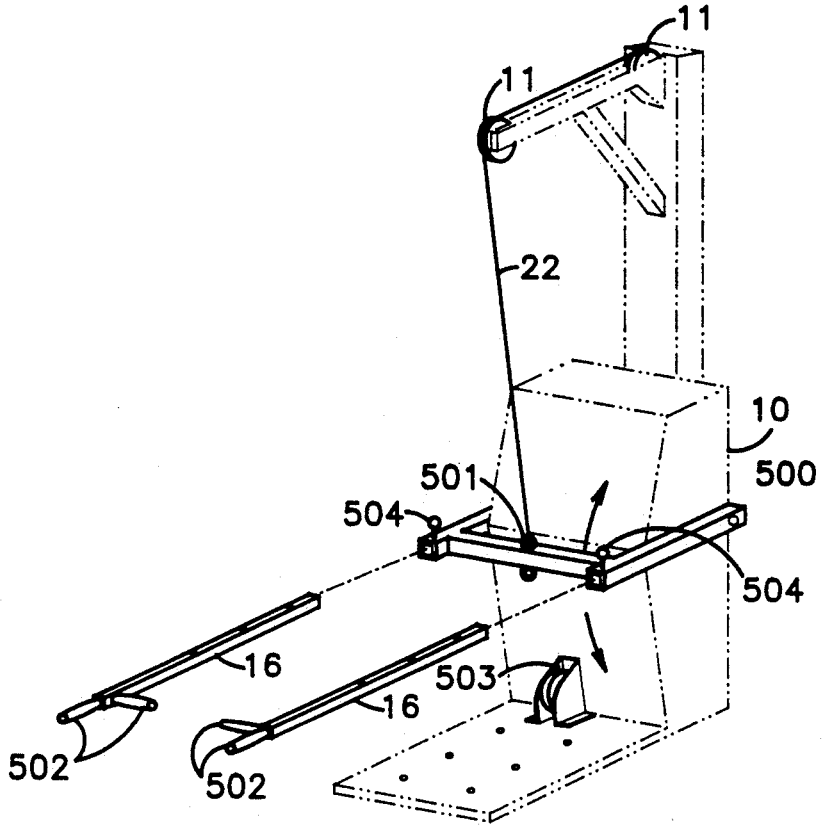
FIG. 9 shows an exercise apparatus having a push assembly means.
Figure 10:
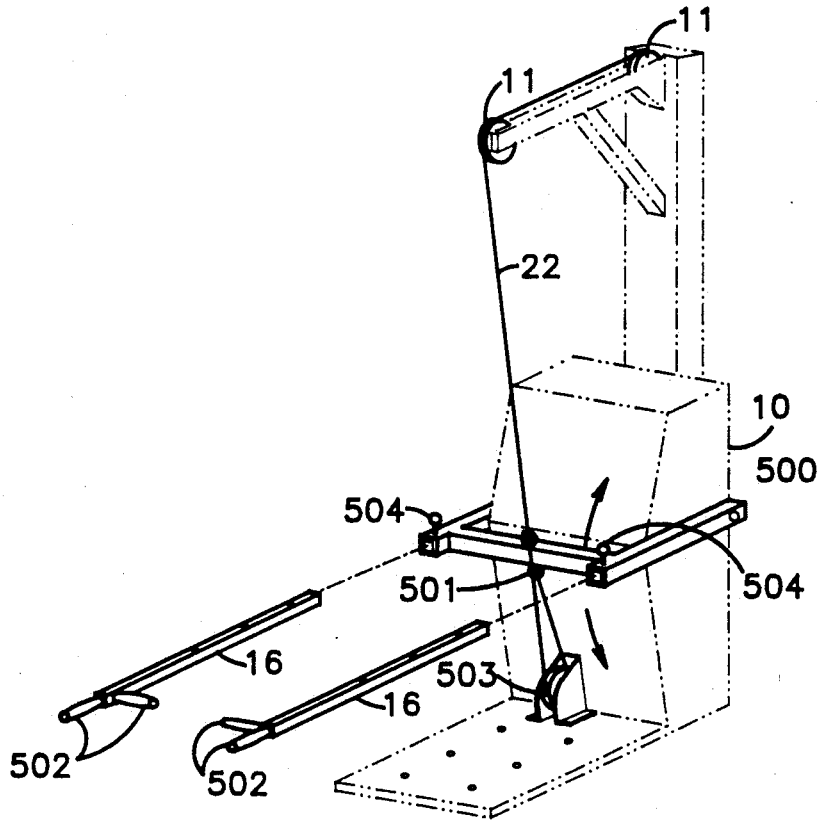
FIG. 10 shows an exercise apparatus having a push assembly means configured for different exercises than those of the configuration shown in FIG. 9.
Figure 11:
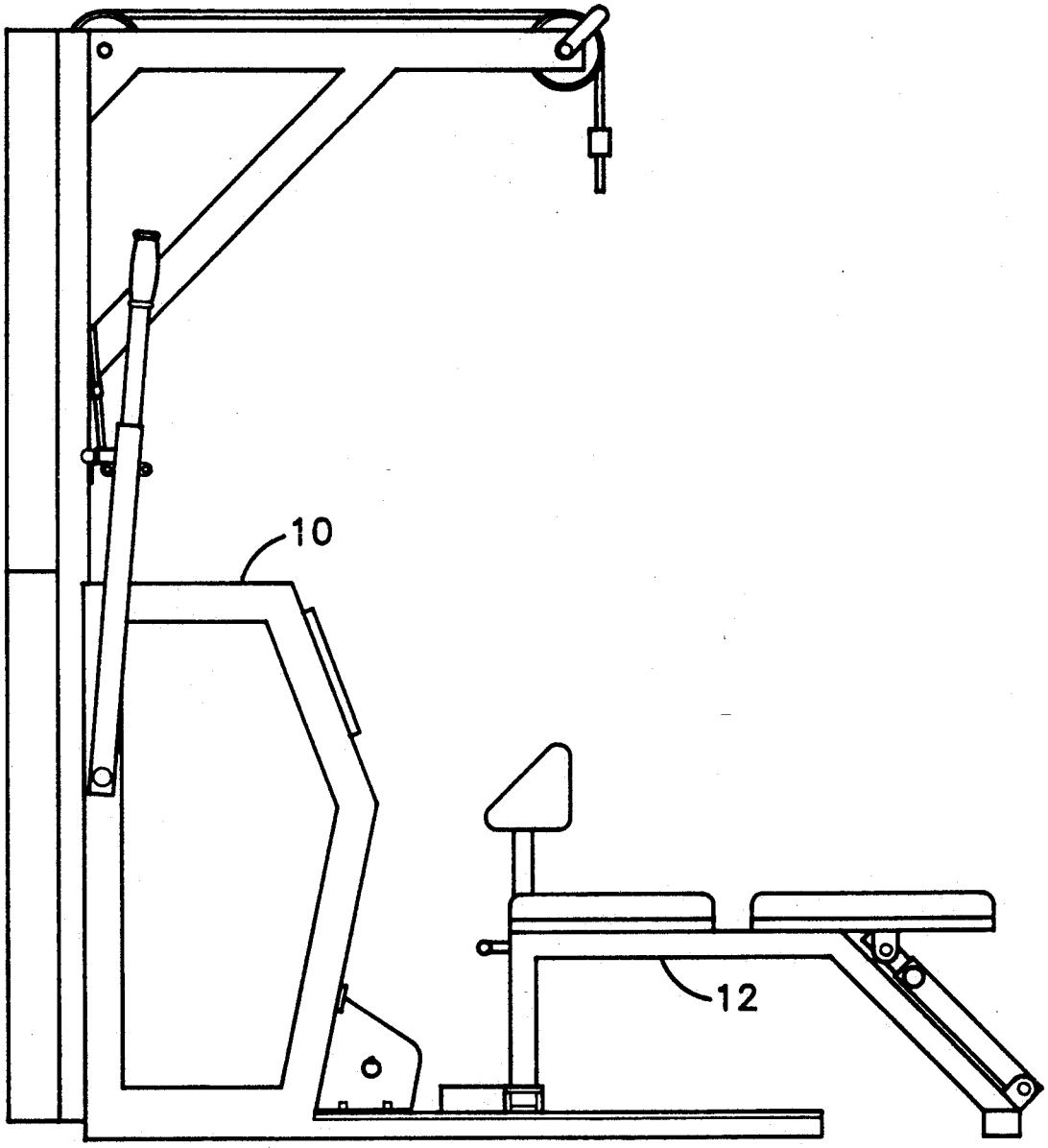
FIG. 11 shows the operator support of the preferred embodiment.

FIGS. 9, 10, and 11 show different configurations for exercise using a push assembly means 500 and a detachably connectable operator support 12. The push assembly means 500 is shown as a "U"-shaped member which is attached via pivot points to a supporting structure 10. Movement of the push assembly 500 is governed by the tension transmitting device 21, in this case cable 22, attached to proper eyelet 501 on the push assembly 500 cross-member. Parallel members of push assembly means 500 are hollow, at least partway therethrough. They have a locking means, in this case spring loaded pop-pins 504, inserted in holes into the hollow at the movable or user ends of the parallel members. User force application device 16, in this case a pair of parallel bars, slide into the hollows of push assembly means 500, forming telescoping extensions. Position holes in parallel bars 16 receive pop-pins 504 and lock parallel bars 16 at the desired extension for the user and the exercise. At the other end of each parallel bar 16 a pair of handles 502 are attached. One handle is mounted in axial alignment with the parallel bar 16. The other handle is mounted transverse or perpendicular to parallel bar 16. Position holes in parallel bars 16 are such that the perpendicular handles may be locked into the push assembly means 500 such that they can either face toward or away from the other parallel bar 16.

FIG. 9 shows the push assembly in a push-down mode of operation. Cable 22 is attached to the top eyelet 501 of the cross-member of push assembly means 500. Downward force is applied by the user onto handles 502 and an opposing upward force is generated on cable 22. The cable extends and retracts in a manner previously described.

FIG. 10 shows the push assembly in a bench press mode of operation. Cable 22 is routed through pulley 503 and connected to the lower eyelet 501 on the cross-member of push assembly means 500. Depending on cable length and apparatus configuration, cable extensions may have to be used. The user applies upward force onto the handles 502, a downward opposing force is generated on the cable 22. The cable extends and retracts in a manner previously described.

FIG. 11 shows the operator support 12, in this case as adjustable exercise bench assembly. The exercise bench assembly 12 can be fastened into threaded holes in the base of supporting structure 10 using a retractable spring-loaded screw down assembly. By being completely retractable into the lower front horizontal leg assembly, the operator support 12 base and the flooring of the user facility are protected. Exercise bench assembly 12 is attached to the base of supporting structure 10 for certain exercises and removed for other exercises which don't require it. Front and rear leg assemblies of the exercise bench assembly 12 are of different height to compensate for the thickness of the base of supporting structure 10.

To use the exercise apparatus, the user decides which of the exercise routines he or she wants to perform and configures the hardware for that exercise. If the operator support 12 is to be used, the user places it in the desired position and may attach it to the supporting structure 10 for added safety. Operator support 12 can be adjusted for the exercise, for example, as a bench for bench presses, or as a chair for overhead exercises. Attachments for arm, leg, or knee support may be added to operator support 12 for exercises such as curls. The user decides which user force application device 16 he or she wishes to use and whether or not he or she will use the push assembly means 500. If necessary, the user adds extensions to the tension transmitting device 21 and correctly routes these extensions over the required pulleys 11 and/or 503. The user will either connect the selected user force application device 16 to the tension transmitting device 21 or push assembly means 500, depending on the exercise selected. If the user force application device 16 is connected to the push assembly means 500, then the proper eyelet 501 of the push assembly means is connected to the tension transmission device 21. The user now assumes the proper exercise position and interfaces the exercise apparatus using keypad 60 and follows the instructions provided to complete the exercise routine.

Figure 12:
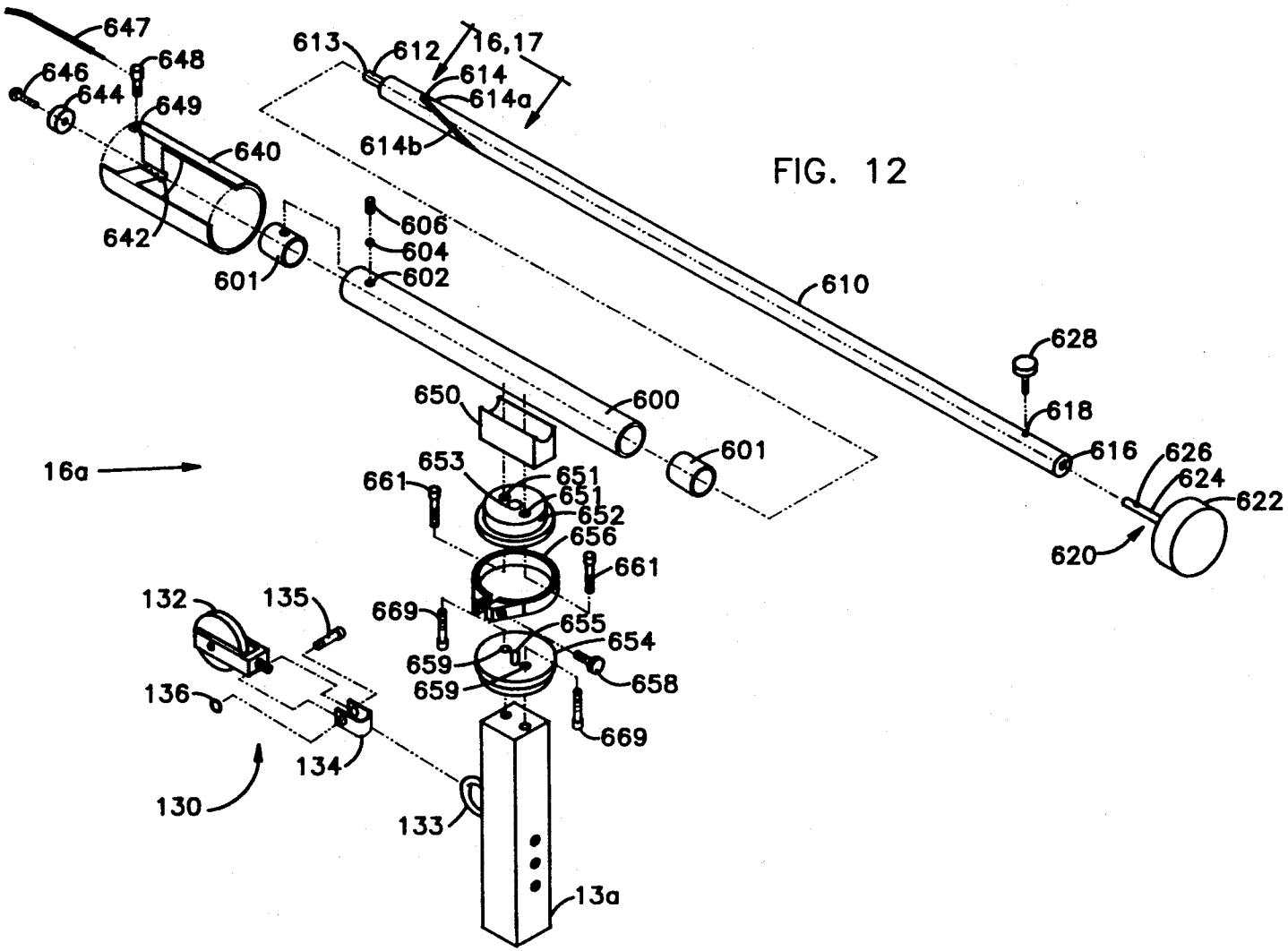
FIG. 12 shows an exploded perspective view of the preferred embodiment.

FIG. 12 shows the preferred embodiment of user force application device **16*a* of the present invention. This device 16*a*** is designed to allow a person to perform exercises which require pushing away from or pulling toward their body, or clockwise or counter-clockwise rotational twisting, or a combination of these.

Before further discussin of the use of the device **16*a*** and other embodiments, an understanding of the hand, wrist, arm, and shoulder anatomy is required. A person's wrist or carpus comprises eight carpal bones, roughly arranged in two rows. Five metacarpal bones make up the palm or metacarpus and connect the wrist to the thumb and finger digits. In order, the digits are the thumb, the index finger, the middle finger, the ring finger, and the little finger. Each finger contains three phalanges, while the thumb contains only two phalanges. The digit metacarpophalangeal joints are between the metacarpals and the phalanges, the thumb interphalangeal joint is between the two phalanges of the thumb, the finger proximal interphalangeal joints are between the finger phalanges nearest the palm, and the finger distal interphalangeal joints are between the finger phalanges nearest the tips of the fingers.

There are thirty-five muscles which are used to move a person's hand. Fifteen of these muscles are in the lower arm and twenty are in the hand. In the hand and wrist, the muscles become slender cords, called tendons, which run along the palm and back of the hand to the digits. In part, short and long finger flexor tendons overlay the finger phalanges; a flexor pollicis longis tendon overlays the thumb phalanges; and lumbrical muscles overlay the finger metacarpals.

Joint flexion results from the motion of a finger or thumb toward the palm, while extension is motion opposite flexion. In addition to flexion and extension of both thumb joints, the thumb has three other units of motion. They are adduction, or the ability to move the thumb across the palm: radial abduction, or the ability to move the thumb away from the index finger; and opposition, or the ability to move the thumb interphalangeal joint opposite the metacarpophalangeal joint of the middle finger.

The lower arm contains two bones, the radius and the ulna. If a person places their hand, wrist, and lower arm parallel to the ground with their palm facing down, wrist flexion is movement at the wrist whereby the finger tips are pointed toward the ground, wrist extension is movement at the wrist whereby the finger tips are pointed upwards, wrist radial deviation is movement at the wrist whereby the finger tips are moved to the left for the right hand and to the right for the left hand, and wrist ulnar deviation is movement at the wrist whereby the finger tips are moved to the right for the right hand and to the left for the left hand.

The elbow has two functional movements, flexion/extension and pronation/supination. If a person stands with his or her shoulder and elbow in a line parallel with the ground and his or her palm facing upward, extension is the movement of the hand, wrist, and lower arm away from the body up to a point where the palm intersects the extension of the line from the shoulder through the elbow. Keeping the shoulder and elbow in a line parallel to the ground, flexion is the movement of the palm toward the body. If a person sets an elbow, lower arm, and heel of his or her hand on a flat surface such as a table such that his or her palm is perpendicular to the flat surface, pronation is the movement by the person of his or her right hand and right lower arm in counter-clockwise direction and his or her left hand and left lower arm in a clockwise direction. This movement causes the palm to move toward a downward facing direction. Supination is the opposite movement, that is the palms move toward an upward facing direction. To accomplish this, a person moves his or her right hand and right lower arm in a clockwise direction and his or her left hand and left lower arm in a counter-clockwise direction.

There are three shoulder motions, flexion/extension, abduction/adduction, and internal/external rotation. A person stands with his or her arm straight down to his or her side, palm facing backwards. Flexion is the movement of the back of the hand, wrist, and arm from straight down upward toward the front of the person's body in a plane perpendicular to a line drawn through the person's two shoulders. Extension is the movement of the palm of the hand, wrist, and arm from straight down backward toward the rear of the person's body in a plane perpendicular to a line drawn through the person's two shoulders.

A person stands with his or her arm straight down to his or her side, palm facing his or her body. Shoulder abduction is the movement of the palm, wrist, and arm from straight down directly away from the body and upwards in the same plane with the body. Rotating the hand, wrist, and arm slightly forward from the shoulder, adduction is the movement of the palm, wrist, and arm from straight down across the front of the body.

A person stands with his or her elbow straight out away from his or her shoulder. The elbow is bent 90 degrees forward so that the person's lower arm points forward and the person's palm is facing downward. The shoulder, elbow, and palm lie in a plane parallel to the ground. External rotation is the movement of the hand, wrist, and lower arm upward. Internal rotation is the movement of the hand, wrist, and lower arm downward. These above described movements are discussed in the *Guides to the Evaluation of Permanent Impairment*, American Medical Association (3d Edition (Revised), 1990).

In real life, individuals perform functional movements which combine some or all of the previously described movements of the fingers, thumb, hand, wrist, lower arm, elbow, upper arm, and shoulder. This results in a person's normal movements being multiplanar. *The Dictionary of Occupational Titles*, U.S. Dept. of Labor (4th Edition, 1977), defines tasks performed and worker traits for various occupations. The *Selected Characteristics of Occupations Defined in the Dictionary of Occupational Titles*, U.S. Dept. of Labor (1981) provides the physical demands and strength factors for these various occupations. An effort is under way to add a skills based system. These references aid a doctor, therapist, or the like, in determining what movements are required to be performed by a person in a particular occupation and what forces the person must be able to exert. Therefore, if the person is injured or needs to be evaluated for a disability, the present invention aids the doctor, therapist, or the like, in determining the person's present capabilities and, if necessary, in designing a rehabilitation, physical therapy, or exercise routine for the person, depending on their unique occupation and physical capabilities, by providing a user force application device which, when used in conjunction with the parent invention, allows concentric and eccentric multiplaner movements of the shoulder, upper arm, elbow, lower arm, wrist, hand, fingers, and thumb.

Referring back to FIG. 12, the preferred embodiment of the user force application device 16*a* of the present invention is shown in an exploded perspective view. The user force application device 16*a* comprises a hollow outer cylinder 600 with a connector end and a user end, an axis, and an outer surface, an inner cylinder 610 with a connector end and a user end, an axis, and an outer surface. Bushings o bearings 601 are inserted into each end of hollow outer cylinder 600. Inner cylinder 610 is inserted into hollow outer cylinder 600 such that the cylinders are in coaxial alignment and the connector ends of hollow outer cylinder 600 and inner cylinder 610 are opposed to the user ends. Inner cylinder 610 is freely slidable and rotatable within hollow outer cylinder 600. With this configuration, a person is able to grasp the user end of inner cylinder 610 and push it through and pull it out of hollow outer cylinder 600. Alternatively, a person can rotate inner cylinder 610 on its axis inside hollow outer cylinder 600. Also, a person can combine these movements.

It is desirable to add a means to provide resistance to the person's movements and to allow the person to secure device 16*a* so that hollow outer cylinder 600 does not move when the person is using device 16*a*. This resistance could easily be provided by attaching one end of a cable to the outer surface of inner cylinder 610 toward the connector end and attaching a free weight to the other end of the cable, so that when inner cylinder 610 is rotated the cable wraps around the outer surface of inner cylinder 610. Those of ordinary skill in the art will see additional ways to provide resistance, such as, for example, using adjustable tension springs. Also, many ways are available to secure outer cylinder 600.

As shown in the preferred embodiment in FIG. 12, device 16*a* is designed to function concentrically and eccentrically with the exercise, physical therapy, or rehabilitation device of the parent invention. A means to detachably connect the connector end of inner cylinder 600 to the tension transmitting device of an exercise, physical therapy, or rehabilitation apparatus and to provide rotational resistance is shown by 612–613 and 640–649. Larger cylinder 640 has a radius designed to provide a desired rotational resistance. The first end of a cable 647 is connected to outer surface of larger cylinder 640 at threaded bore 649 using bolt 648. If larger cylinder 640 is rotated on its axis 180 degrees, cable 647 will wrap halfway around larger cylinder 640, or a distance equal to pi times the radius of larger cylinder 640. Therefore, increasing the radius of larger cylinder 640 increases the resistance provided by increasing the rotational arc of the cable 647. Therefore, a selection of larger cylinders 640 can be provided, with the user selecting the desired one and attaching it to device 16*a*.

There are a variety of way to attach larger cylinder 640 to the connector end of inner cylinder 610. As shown in the preferred embodiment of FIG. 12, at the connector end of inner cylinder 610, the radius of inner cylinder 610 is reduced for a relatively short axial distance toward the user end. This reduced radius is "r" and the axial distance is a length "1" and is shown as 612. Also, there is an axial bore 613 in the connector end of inner cylinder 610. Larger cylinder 640 has a connector end and a user end. Larger cylinder 640 is axially hollowed from the user end partway toward the connector end with this hollow having a radius sufficient such that larger cylinder 640 will clear the outer surface of hollow outer cylinder 600. Then, larger cylinder 640 is axially hollowed on toward its connector end a distance very slightly greater than "1" with a radius equal to "r", shown as a bore 642. Then, larger cylinder 640 is axially hollowed the rest of the way to its connector end with a radius greater than "r". Pressure washer 644 and screw 646 are used to secure larger cylinder 640 to the connector end of inner cylinder 610. The routing and connectivity of the second end of cable 647 is discussed later with FIG. 15.

A means to secure user force application device is provided. This is shown in FIG. 12 by 13*a* and 650–669. An adjustable arm support attachment 13*a* having an upper and lower end is shown in the preferred embodiment. As will be seen in a later figure, for exercise, the lower end of adjustable arm support attachment 13*a* will be secured to exercise bench assembly 12 at the desired height. Mounting block 650 is shown having a flat surface and an opposed inwardly curved surface, the opposed inwardly curved surface of the mounting block 650 has a radius equal to the radius of the hollow outer cylinder 600. The outer surface of hollow outer cylinder 600 is connected to the opposed inwardly curved surface of mounting block 650. Also, an upper 652 and lower 654 circular face plate is provided, each circular face plate 652 and 654 having a first flat circular side parallel to a second flat circular side. The first flat circular side has a radius less than that of the second flat circular side. The first flat circular side of upper circular face plate 652 is connected to the flat surface of mounting block 650. In the preferred embodiment, the connectivity of upper circular face plate 652, mounting block 650, and hollow outer cylinder 600 is accomplished by having a pair of threaded bores 651 from the second flat circular side of upper circular face plate 652 through upper circular face plate 652, through mounting block 650 from its flat surface to its opposed inwardly curved surface, and from the outer surface of hollow outer cylinder 600 into its hollow center. Upper circular face plate 652 mounting block 650, and hollow outer cylinder 600 are then securely connected by inserting threaded set screws 661 into the pair of threaded bores 651 The first flat circular side of lower circular face plate 654 is connected to the upper end of adjustable arm support attachment 13*a*. In the preferred embodiment, this is again accomplished with a pair of threaded bores 659 from the second flat circular side of lower circular face plate 654 through lower circular face plate 654 into the upper end of adjustable arm support attachment 13*a* and then inserting threaded set screws 669 into this pair of threaded bores.

An alignment guide 655 extends upward and outward from the second flat circular side of lower circular face plate 654 at its center point. A corresponding alignment bore 653 extends inward from the second flat circular side of upper circular face plate 652. An adjustable clamp 656 having a tightening knob 658 is used to hold the second flat circular side of the upper circular face plate 652 against the second flat circular side of the lower circular face plate 654, such that the user force application device is in the desired exercise position as set by the user. Alignment guide 655 and alignment bore 653 ensure proper alignment of face plates 652 and 654 and the fact that the radius of the second flat circular sides of upper 652 and lower 654 circular face plates is greater than the radius of their first flat circular sides aids the user in securing face plates 652 and 654 with adjustable clamp 656.

A pulley assembly 130 is shown which is attached to eye bolt 133 connected to adjustable arm support attachment 13*a* near its upper end. U-shaped clamp 134, pin 135, and pin spring 136 are used for attaching pulley assembly 130 to eye bolt 133. With this connection, pulley 132 is used for routing cable 647 to a tension transmitting device of an exercise, physical therapy, or rehabilitation apparatus, such as that in the parent invention, in order to use user force application device 10*a* in push or twist or push and twist exercises. To use user force application device 16*a* in pull or pull and twist exercises, pulley assembly 130 is attached to either eyelet 501 on the cross-member of push assembly means 500, shown in FIGS. 9, 10 and 15. For proper use, the U-shaped member of push assembly means 500 should be positioned parallel to the ground, as shown in FIGS. 9 and 10.

Without more, inner cylinder 610 freely slides and rotates inside hollow outer cylinder 600. In this configuration, the user can push or pull inner cylinder 610 through hollow outer cylinder 600 with no rotational action, or the user can rotate inner cylinder either clockwise or counter-clockwise while pushing or pulling, or the user may simply rotate inner cylinder 610 without any pushing or pulling. This allows the user to do all of the movements previously described for the fingers, thumb, hand, wrist, lower arm, elbow, upper arm, and shoulder alone or in combination. Not all users will be able to rotate inner cylinder 610, particularly if they are injured and undergoing therapy. Additionally, therapists may wish to restrict a user to only a push/pull motion or a twist motion. Therefore, a means to restrict the movement of inner cylinder 610 inside hollow outer cylinder 600 is provided. This movement can be restricted to push/pull movement only with no rotation, rotation only with no push/pull movement, clockwise rotation with push/pull movement, and counter-clockwise rotation with push/pull movement. All of these restricted movements can be implemented into user force application device 16*a*.

Figure 16:
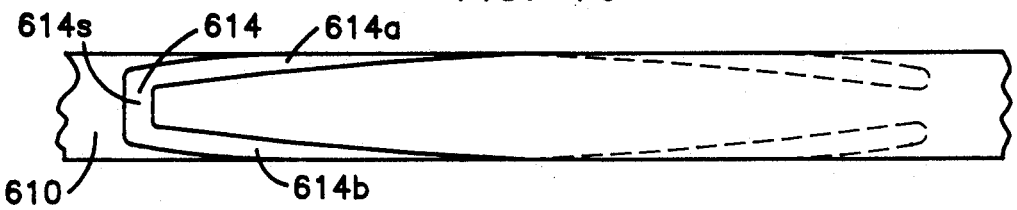
FIG. 16 shows a top view of a portion of an inner cylinder shown in FIG. 12, showing the groove therein; and, FIG. 17 shows a bottom view of the portion of the inner cylinder in FIG. 16.
Figure 17:
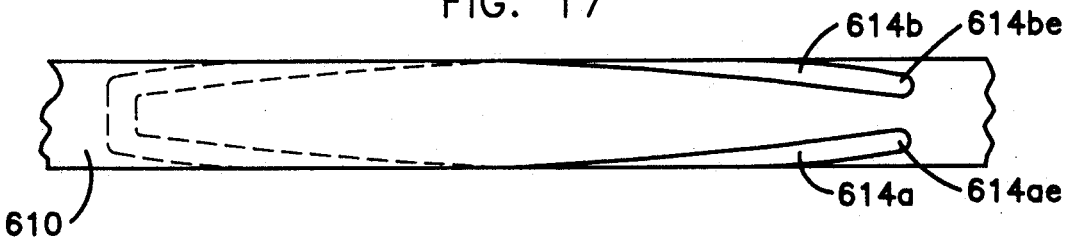

In the preferred embodiment, this is accomplished by grooves in inner cylinder 610 and groove guides in hollow outer cylinder 600. FIGS. 12, 16, and 17 show how a clockwise or counter-clockwise rotation with push/pull movement is implemented. A groove 614 is hollowed into the outer surface of the inner cylinder 610. The groove 614 starts at a point, identified on FIG. 16 as 614*s* on the outer surface of inner cylinder 610 toward the connector end of the inner cylinder 610 and spirals both clockwise (614*a*) and counter-clockwise (614*b*) around the outer surface of the inner cylinder 610 toward the user end of the inner cylinder 610. The clockwise and counter-clockwise helical spirals 614*a* and 614*b*, respectively, of groove 614 can be allowed to intersect or can be ended at two points, identified on FIG. 17 as 614*ae* and 614*be* on the outer surface of inner cylinder 610 which are each just less than 180 degrees from the point on the outer surface of inner cylinder 610 at which groove 614 started. It is recommended to have a 180 degree rotation over at least 12 inches of push-/pull movement. In the preferred embodiment, there is a radial threaded bore 602 from the outer surface of hollow outer cylinder 600 to the inner surface of hollow outer cylinder 600. A guide is inserted into radial bore 602, such that the guide engages groove 614 hollowed into the outer surface of inner cylinder 610. As shown, this guide is bearing 604. A set screw 606 is then inserted into threaded radial bore 602 to ensure continuous engagement of bearing 604 with groove 614. In this configuration, inner cylinder 610 must rotate as allowed by groove 614 when inner cylinder 610 moves axially through hollow outer cylinder 600.

When used with a guide, a circumferential groove into the outer surface of inner cylinder 610 would only permit rotational movement of inner cylinder 610, while an axial groove would only permit push/pull movement. A circumferential groove, an axial groove, a clockwise helical groove, a counter-clockwise helical groove, or some combination of these grooves can be made into the outer surface of inner cylinder 610. Bearing 604 is then engaged into the proper groove for the desired restricted movement of inner cylinder 610.

It is desirable to have different size and shape grips to accommodate the varied hand sizes of different users; the different finger flexion/extension capabilities of users, particularly those undergoing rehabilitation therapy; and, the many different push, pull, and twisting movements which the present invention allows. Therefore, a variety of grips will be provided and they will be discussed later.

FIG. 12 shows an easily removable grip 620. Grip 620 contains a handle 622, an insert 624 with a bore 626 therethrough. Insert 624 needs to be inserted into the user end of inner cylinder 610 and secured. As shown in FIG. 12, this can be accomplished by having an axial bore 616 into the user end of inner cylinder 610. A threaded bore 618 goes from the outer surface to the axis of inner cylinder 610, intersecting axial bore 616, such that when insert 624 is inserted into axial bore 616, a threaded grip fastener 628 can be screwed into threaded bore 618 and pass through bore 626 of insert 624.

Figure 13:
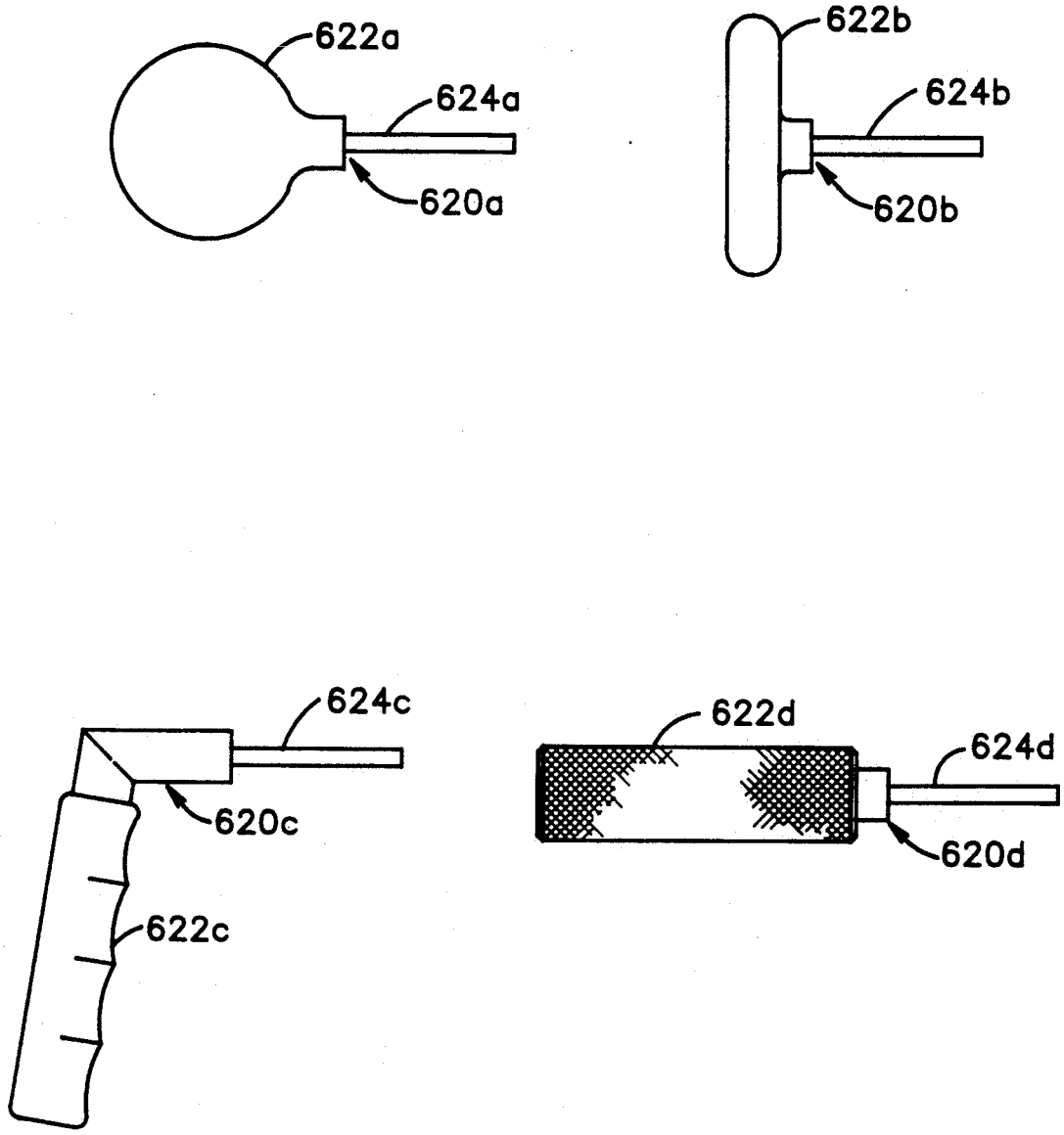
FIG. 13 shows the shapes of some of the grips used with the present invention.
Figure 14:
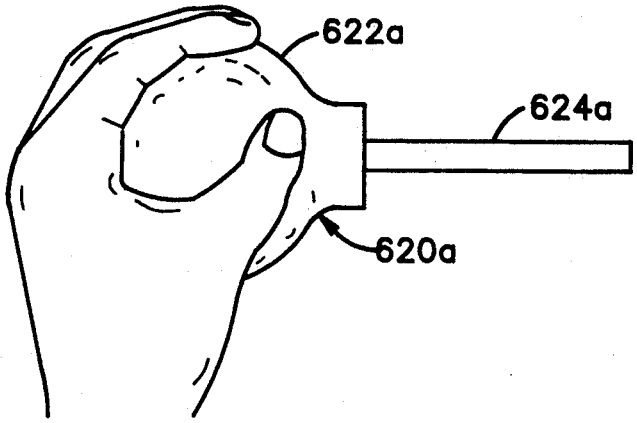
FIG. 14 shows how a user would grasp selected grips used with the present invention.
Figure 14:
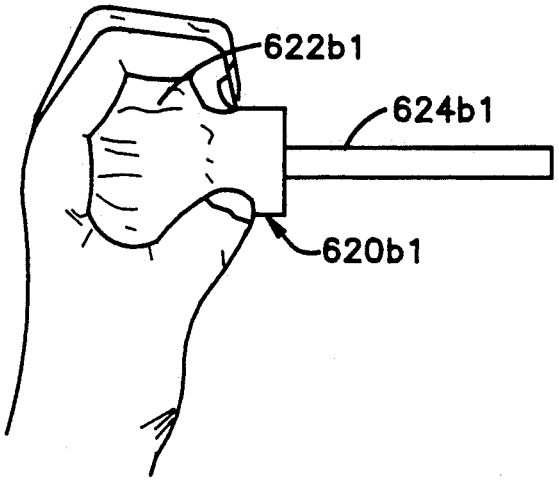
Figure 14:
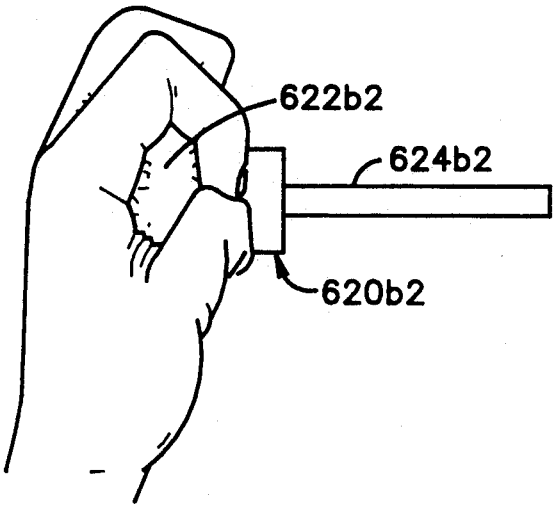

Referring now to FIGS. 13 and 14, FIG. 13 shows the shapes of some of the grips used with the present invention and FIG. 14 shows how a user would grasp some selected grips used with the present invention. Grip 620*a* of FIG. 13 shows a grip having a spherical-shaped handle 622*a*. It is recommended that at least three spherical-shaped handles 622 of differing diameter be made available to the user. Recommended diameters are 3 ¾ inches, 3 3/16 inches, and 2 ⅝ inches, to accommodate the widest range of users. The larger diameter sphere grip allows patients with limited mobility to participate in rehabilitation by giving them a large surface to grasp with little joint flexion, thus decreasing stress on the digit joints. This device is particularly helpful in rehabilitation of patients having arthritis or tendon injuries. The intermediate diameter spherical-shaped grip can be used as a patient's joint flexion increases. This is particularly helpful in resolving injuries to the short finger flexor tendons. The smallest diameter spherical-shaped grip is used as flexion increases and is helpful with long finger flexor tendon rehabilitation.

Grip 620*b* of FIG. 13 would be used by someone having greater flexion than someone who would use the spherical-shaped grip 620*a*. Grip 620*b* has a disk-shaped handle 622*b*, having parallel inner and outer surfaces and a curved edge. The edge is a full radius arc, the radius being one-half the distance from the inner surface to the outer surface of the disk. This edge curvature allows a user to comfortably wrap his or her hand around the disk. At least two disk-shaped grips 620*b* having different dimensions are recommended. The recommended dimensions of one disk are 1½ inches from inner to outer surface of the disk and 3⅜ inches from edge to edge measured at a point halfway between the inner and outer surfaces of the disk. For the other disk, the recommended dimensions are ¾ inches from inner to outer surface of the disk and 4 inches from edge to edge measured at a point halfway between the inner and outer surfaces of the disk. The disk-shaped grip 620*b* selected will depend on the amount of interphalangeal joint flexion of the user.

Grip 620*c* of FIG. 13 is an angled bicycle type grip. This grip 620*c* is very useful in exercises involving elbow pronation/supination and shoulder abduction-/adduction. Grip 620*d* of FIG. 13 is cylindrical-shaped rod. It is desirable to have various diameter rods to accommodate the physical differences of the users.

FIG. 14 shows how a user could grasp a spherical-shaped grip 620*a*, and two different size disk-shaped grips 620*b*1 and 620*b*2. As shown, the user places a palm on the handle of the selected device and then wraps the fingers and thumb around the spherical-shaped handle 622*a* or disk-shaped handle 620*b*1 or 620*b*2. As shown, the user of the spherical-shaped grip 620*a* has less flexion than the user of one of the disk-shaped grips 620*b*1 or 620*b*2. Further, the user of the disk-shaped grip 620*b*2 with the smallest distance between the inner and outer surfaces of the disk has more flexion than the user of the disk 620*b*1 with the greatest distance between the inner and outer surfaces of the disk.

Figure 15:
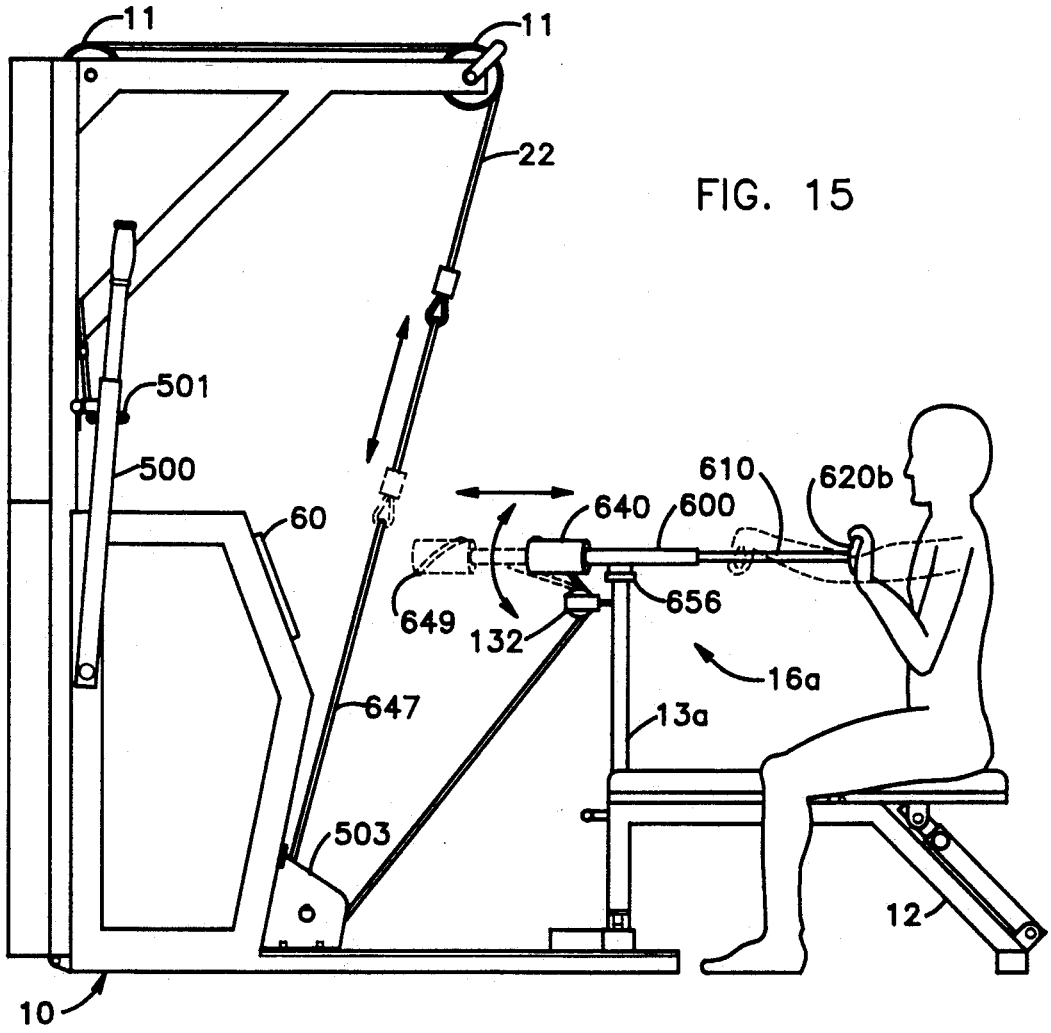
FIG. 15 shows the side view of a person using the user force application device in conjunction with an exercise; physical therapy, or rehabilitation apparatus.

FIG. 15 show a patient doing one possible exercise using user force application device 16*a* of the present invention in conjunction with an exercise, physical therapy, or rehabilitation apparatus 10. The patient has attached exercise bench assembly 12 to the base of supporting structure 10 by inserting the retractable spring-loaded screw down assembly into the appropriate threaded holes of base 10. Adjustable arm support attachment 13*a* was inserted into exercise bench assembly 12 and set at the proper height for the patient to place his or her arms in the proper position for the desired exercise; as shown, the patient's shoulder and extended arm will be parallel to the ground. Also, the patient has tightened knob 658 of adjustable clamp 656 so that user force application device 16*a* is in the desired axial alignment. The patient also selected grip 620*b*, as shown in FIG. 13, having disk-shaped handle 622*b*. The patient has inserted grip 620*b* insert 624*b* into bore 616 of inner cylinder 610 and secured it with grip fastener 628. The patient has attached the second end of cable 647 of user force application device 16*a* to the first end of tension transmitting device 21, shown as cable 22, ensuring that cable 22 and cable 647 were correctly routed around pulleys 132, 503, and 11 in order to perform a push and twist exercise routine. The patient in FIG. 15 is not using groove 614 to restrict the movement of inner cylinder 610 inside hollow outer cylinder 600. The patient now assumes the proper exercise position and interfaces the exercise apparatus using keypad 60 and follows the previously described instructions to complete the selected exercise routine.

In FIG. 15, at the start of the exercise, the patient is holding handle 622*b* of grip 620*b* with his or her palm facing away from his or her body and with his or her fingers flexed over edge of handle 622*b*, digit metacarpophalangeal joints or knuckles pointing upward. His or her shoulder is in an abducted position, elbow flexed and pronated, and wrist partially extended. In the phantom lines, the patient has increased his or her shoulder flexion, decreased shoulder abduction, extended and supinated the elbow by rotating counter-clockwise 180 degrees, and further extended the wrist. This is only one possible exercise, and those skilled in the art can easily see how user force application device 16*a* can be used to accomplish various combinations of all of the movements previously described with the discussion of FIG. 12.

As can be seen in FIG. 15, at the start of the exercise, cable 647 is partially wrapped clockwise around large cylinder 640 from the patient's perspective. When the exercise begins, the exercise, physical therapy, or rehabilitation apparatus starts to slowly extend cable 22 and, therefore, cable 647. This permits the patient to push inner cylinder 610 away from his o her body in a concentric exercise. As shown, the patient has also combined a counter-clockwise rotational movement of inner cylinder 610 with this pushing movement. This counter-clockwise rotation causes cable 647 to wrap around the outer surface of large cylinder 640, as shown, thus providing the rotational resistance previously described. When inner cylinder 610 reaches the position shown by the phantom lines, the exercise, physical therapy, or rehabilitation apparatus starts to slowly retract cable 22 and, therefore, cable 647. The patient resists the movement of the user end of inner cylinder 610 toward his or her body resulting in an eccentric exercise. The patient can also rotate inner cylinder 610 during this retraction portion of the exercise in order to return to the original position. The patient can vary the force he or she exerts at any time during the concentric or eccentric portions of the exercise.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A user force application device, comprising: a hollow outer cylinder having a connector end and a user end, an outer surface and an inner surface, and an axis; an inner cylinder having a connector end and a user end, an outer surface, and an axis, said inner cylinder inserted into said hollow outer cylinder and in coaxial alignment therewith, said inner cylinder being freely rotatable around said axis and freely slidable within said hollow outer cylinder along said axis, said connector ends of said hollow outer cylinder and said inner cylinder opposing said user ends of said hollow outer cylinder and said inner cylinder; a grip detachably connected to said user end of said inner cylinder, said grip having a handle; and, means to detachably connect said connector end of said inner cylinder to the tension transmitting device of an exercise apparatus and to provide rotational resistance.

2. The user force application device of claim 1, wherein said handle of said grip is spherical-shaped.

3. The user force application device of claim 1, wherein said handle of said grip is disk-shaped.

4. The user force application device of claim 1, wherein said means to detachably connect said connector end of said inner cylinder to the tension transmitting device of an exercise apparatus and to provide rotational resistance comprises: a larger cylinder having a connector end and a user end, an outer surface, and an axis; said larger cylinder connected to said connector end of said inner cylinder and in coaxial alignment therewith; said connector ends of said larger cylinder, said inner cylinder, and said hollow outer cylinder opposing said user ends of said larger cylinder, said inner cylinder, and said hollow outer cylinder; a connector having a first and second end, said first end of said connector being connected to said outer surface of said larger cylinder toward said connector end of said larger cylinder and said second end of said connector being detachably connected to said tension transmitting device.

5. The user force application device of claim 1, further comprising: means to restrict the movement of said inner cylinder inside said hollow outer cylinder.

6. A user force application device, comprising: a hollow outer cylinder having a connector end and a user end, an outer surface and an inner surface, and an axis; an inner cylinder having a connector end and a user end, an outer surface, and an axis, said inner cylinder inserted into said hollow outer cylinder and in coaxial alignment therewith, said inner cylinder being freely rotatable around said axis and freely slidable within said hollow outer cylinder along said axis, said connector ends of said hollow outer cylinder and said inner cylinder opposing said user ends of said hollow outer cylinder and said inner cylinder; and, an arm support attachment having an upper and lower end and means to detachably connect said upper end of said arm support attachment to said outer surface of said hollow outer cylinder; wherein said means to detachably connect said upper end of said arm support attachment to said outer surface of said hollow outer cylinder includes a mounting block having a flat surface and an opposed inwardly curved surface, said opposed inwardly curved surface of said mounting block having a radius equal to the radius of said hollow outer cylinder, said outer surface of said hollow outer cylinder connected to said opposed inwardly curved surface of said mounting block, an upper and lower circular face plate, each circular face plate having a first flat circular side parallel to a second flat circular side, said first flat circular side having a radius less than that of said second flat circular side, said first flat circular side of said upper circular face plate connected to said flat surface of said mounting block, said first flat circular side of said lower circular face plate connected to said upper end of said arm support attachment; and an adjustable clamp, said adjustable clamp tightened by the user to hold said second flat circular side of said upper circular face plate against said second flat circular side of said lower circular face plate, such that said user force application device is in the desired exercise position as set by the user.

7. The suer force application device of claim 6, further comprising: a pulley assembly connected to said arm support attachment.

8. A user force application device, comprising: a hollow outer cylinder having a connector end and a user end, an outer surface and an inner surface, and an axis; an inner cylinder having a connector end and a user end, an outer surface, and an axis, said inner cylinder inserted into said hollow outer cylinder and in coaxial alignment therewith, said inner cylinder being freely rotatably around said axis and freely slidable within said hollow outer cylinder along said axis, said connector ends of said hollow outer cylinder and said inner cylinder opposing said user ends of said hollow outer cylinder and said inner cylinder; and, means to restrict the movement of said inner cylinder inside said hollow outer cylinder; wherein said means to restrict the movement of said inner cylinder inside said hollow outer cylinder includes a groove hollowed into said outer surface of said inner cylinder; a radial bore from said outer surface of said hollow outer cylinder to said inner surface of said hollow outer cylinder; a groove guide inserted into said radial bore, said groove guide engaging said groove hollowed into said outer surface of said inner cylinder; and a plug inserted into said radial bore after said guide to ensure continuous engagement of said groove guide with said groove.

9. The user force application device of claim 8, wherein said groove is a circumferential groove around said outer surface of said inner cylinder, said circumferential groove being in a plane transverse to said axis of said inner cylinder.

10. The user force application device of claim 8, wherein said groove hollowed into said outer surface of said inner cylinder is parallel to said axis of said inner cylinder.

11. The user force application device of claim 8, wherein said groove starts at a point on said outer surface of said inner cylinder toward said connector end of said inner cylinder and spirals around said outer surface of said inner cylinder toward said user end of said inner cylinder.

12. The user force application device of claim 8, wherein said groove starts at a point on said outer surface of said inner cylinder toward said connector end of said inner cylinder and said groove has a clockwise helical spiral and a counter-clockwise helical spiral, said spirals spiraling around said outer surface of said inner cylinder from said groove starting point toward said user end of said inner cylinder.

13. The user force application device of claim 12, wherein said clockwise helical spiral and said counter-clockwise helical spiral end at two points on said outer surface of said inner cylinder which are each just less than 180 degrees from the point on said outer surface of said inner cylinder at which said groove started.

14. The user force application device of claim 13, wherein the axial distance on said inner cylinder from the starting point of said groove to said ending points of said spirals is a minimum of 12 inches.

15. The user force application device of claim 8, wherein said groove guide is a bearing.

16. In combination with an exercise apparatus having a linearly extendable and retractable tension transmitting device having a first end and a second end, said second end connected to a movement control means which regulates the extension and retraction of the tension transmitting device, said control means being operably connected to a force measuring device which determines the tension applied to said tension transmitting device and provides an electronic signal representing this tension to a control computer, the improvement which comprises a user force application device, comprising:

(a) a hollow outer cylinder having a connector end and a user end, an outer surface and an inner surface, and an axis;

(b) an inner cylinder having a connector end and a user end, an outer surface, and an axis, said inner cylinder inserted into said hollow outer cylinder and in co-axial alignment therewith, said inner cylinder being freely rotatable around said axis and freely slidable within said hollow outer cylinder along said axis, said connector ends of said hollow outer cylinder and said inner cylinder opposing said user ends of said hollow outer cylinder and said inner cylinder;

(c) a grip detachably connected to said user end of said inner cylinder, said grip having a handle;

(d) a larger cylinder having a connector end and a user end, an outer surface, and an axis; said larger cylinder connected to said connector end of said inner cylinder and in coaxial alignment therewith; said connector ends of said larger cylinder, said inner cylinder, and said hollow outer cylinder opposing said user ends of said larger cylinder, said inner cylinder, and said hollow outer cylinder;

(e) a connector having a first and second end, said first end of said connector being connected to said outer surface of said larger cylinder toward said connector end of said larger cylinder and said second end of said connector being detachably connected to said first end of said tension transmitting device;

(f) an arm support attachment having an upper and lower end;

(g) a mounting block having a flat surface and an opposed inwardly curved surface, said opposed inwardly curved surface of said mounting block having a radius equal to the radius of said hollow outer cylinder, said outer surface of said hollow outer cylinder connected to said opposed inwardly curved surface of said mounting block, (h) an upper and lower circular face plate, each circular face plate having a first flat circular side parallel to a second flat circular side, said first flat circular side having a radius less than that of said second flat circular side, said first flat circular side of said upper circular face plate connected to said flat surface of said mounting block, said first flat circular side of said lower circular face plate connected to said upper end of said arm support attachment; and, (i) an adjustable clamp, said adjustable clamp tightened by the user to hold said second flat circular side of said upper circular face plate against said second flat circular side of said lower circular face plate, such that said user force application device is in the desired exercise position as set by the user.

17. The user force application device of claim 16, further comprising: a groove hollowed into said outer surface of said inner cylinder; a radial bore from said outer surface of said hollow outer cylinder to said inner surface of said hollow outer cylinder; a groove guide inserted into said radial bore, said groove guide engaging said groove hollowed into said outer surface of said inner cylinder; and a plug inserted into said radial bore after said guide to ensure continuous engagement of said groove guide with said groove.

* * * * *

UNITED STATES PATENT AND TRADEMARK OFFICE

CERTIFICATE OF CORRECTION

PATENT NO. : 5,254,066

DATED : October 19, 1993

INVENTOR(S) : MICHAEL L. BROWN, JAN W. MILLER, WILBUR W. SPATIG, DEAN M. ZIGORIS

It is certified that error appears in the above-indentified patent and that said Letters Patent is hereby corrected as shown below:

Column 7, line 58, insert —l —.

Column 15 Line 49 delete "discussin" insert --discussion--

Column 17 Line 50 delete "o" insert --or--

Column 19 Line 16 after "bores 651" before "The" insert --.--

Column 22 Line 54 delete "o" insert --or--

Column 24 Line 23 (Claim 7) delete "suer" insert --user--

Signed and Sealed this

Sixth Day of September, 1994

*Attest:*

Bruce Lehman

BRUCE LEHMAN

*Attesting Officer*

*Commissioner of Patents and Trademarks*